US006704037B1

(12) United States Patent
Taguchi

(10) Patent No.: US 6,704,037 B1
(45) Date of Patent: Mar. 9, 2004

(54) THERMAL TRANSFER RECORDING APPARATUS AND THERMAL TRANSFER RECORDING METHOD USING THE SAME

(75) Inventor: Nobuyoshi Taguchi, Ikoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 64 days.

(21) Appl. No.: 10/009,968

(22) PCT Filed: Jun. 15, 2000

(86) PCT No.: PCT/JP00/03875

§ 371 (c)(1),
(2), (4) Date: Dec. 14, 2001

(87) PCT Pub. No.: WO00/76774

PCT Pub. Date: Dec. 21, 2000

(30) Foreign Application Priority Data

Jun. 16, 1999 (JP) ..... 11-169252
Jun. 16, 1999 (JP) ..... 11-169254
Feb. 23, 2000 (JP) ..... 2000-045485
Feb. 23, 2000 (JP) ..... 2000-045486

(51) Int. Cl.[7] ..... B41J 2/325
(52) U.S. Cl. ..... 347/213
(58) Field of Search ..... 347/213, 171–176, 347/219; 399/60, 302, 162, 167; 400/120.01, 120.02, 120.04, 120.16

(56) References Cited

U.S. PATENT DOCUMENTS 5,448,282 A 9/1995 Imai et al. ..... 347/213
5,502,477 A * 3/1996 Osada et al. ..... 347/176
5,512,986 A * 4/1996 Toyomura et al. ..... 399/60
5,708,467 A 1/1998 Yoshikawa et al. ..... 347/213
5,990,916 A * 11/1999 Fassler et al. ..... 347/171
6,097,415 A 8/2000 Kita et al. ..... 347/213
6,195,112 B1 * 2/2001 Fassler et al. ..... 347/219

FOREIGN PATENT DOCUMENTS

| | | |
|---|---|---|
| JP | 59-225994 | 12/1984 |
| JP | 63-81093 | 4/1988 |
| JP | 4-156384 | 5/1992 |
| JP | 4-347658 | 12/1992 |
| JP | 6-297863 | 10/1994 |
| JP | 7-132686 | 5/1995 |
| JP | 7-156428 | 6/1995 |
| JP | 8-2124 | 1/1996 |
| JP | 8-67016 | 3/1996 |
| JP | 8-324008 | 12/1996 |
| JP | 2670539 | 7/1997 |
| JP | 9-300673 | 11/1997 |

* cited by examiner

*Primary Examiner*—Lamson Nguyen
*Assistant Examiner*—K. Feggins
(74) *Attorney, Agent, or Firm*—Wenderoth, Lind & Ponack, L.L.P.

(57) ABSTRACT

A thermal transfer recording apparatus for recording a glossy and high quality image alleviates or substantially solves at least one of the problems of low recording speed of the image, poor stability of recording, and high running cost of recording. The thermal transfer recording apparatus has an intermediate record support which forms a closed loop and extends over a plurality of drums which are placed separately, and a dye receiving layer transfer section having a dye receiving layer transfer head which faces a part of the intermediate record support on an outer periphery of one drum of the plurality of the drums. The thermal transfer recording apparatus also has an image recording section having at least one image recording head which faces a part of the intermediate record support on an outer periphery of the one drum, and an image transfer section having an image transfer head which faces the intermediate record support inside of the closed loop.

34 Claims, 7 Drawing Sheets

THERMAL TRANSFER RECORDING APPARATUS AND THERMAL TRANSFER RECORDING METHOD USING THE SAME

TECHNICAL FIELD

The present invention relates to a thermal transfer recording apparatus (e.g., a thermal transfer printer) and a thermal transfer recording method (e.g., a thermal transfer printing method). In particular, the present invention relates to a thermal transfer recording apparatus and a thermal transfer recording method in which a full-colored and high quality image can be formed on a plain paper at a high speed and a low cost, for example, in a digital mode.

BACKGROUND ART

A thermal transfer recording method in which a dye is transferred by heating can provide an image having a high quality which is substantially equivalent to that of the silver halide conventional full color photograph. Furthermore, the thermal transfer recording method is an excellent recording technique which puts less of a load on the global environment and which allows instant recording (or printing) (i.e., recording can be done immediately). An apparatus for such a method is compact and excellent in its maintainability.

However, it is necessary to use a substrate as an image receiver comprising pulp paper, both surfaces of which are laminated with a formed polyester (PET) film, etc. in order to reproduce a high quality image. Therefore, the thermal transfer recording method has a disadvantage in that the substrate, which is expensive, is to be used as the image receiver, and no other substrate can be selected. This means a lower degree of freedom as to the substrate selection. Several thermal transfer recording methods which are called re-transfer recording methods have been proposed in order to solve such a problem.

The first re-transfer recording method is a method wherein an image is recorded (i.e., printed) by thermal transfer of a dye on a dye receiving layer supporting sheet (a sheet which carries a dye receiving layer) which is obtained by forming the dye receiving layer (a layer on which the image is to be recorded (or printed)) on a thin sheet-form substrate such as a PET film with a method such as a coating method, and the dye receiving layer on which the image has been formed (or recorded) is re-transferred to a (final) image receiver such as paper (see, for example, Japanese Patent Kokai Publication No.63-81093). However, the dye receiving layer supporting sheet is made of the thin sheet-form substrate and the image is formed on the dye receiving layer on such a sheet-form substrate by thermally transferring the dye, so that the first re-transfer recording method has problems in that registration of the image is difficult and in that it is not always easy to handle the dye receiving layer supporting sheet in an apparatus. Therefore, a second re-transfer recording method has been proposed as a method which can solve those problems caused by the dye receiving layer supporting sheet.

The second re-transfer recording method is a method wherein an intermediate record support (a medium which temporarily keeps the dye receiving layer during recording (or printing)) is used which forms a closed loop such as a drum or a belt (e.g., an endless belt). The method in which the drum is used is disclosed in Japanese Patent Kokai Publication No.4-156384 and the method in which the belt is used is disclosed in Japanese Patent Kokai Publication No.8-67016. In this method, a dye receiving layer transferer (a medium which carries a dye layer to be transferred (moved) to the intermediate record support) is heated while being pressed, so that first, the dye receiving layer is transferred onto the intermediate record support from the dye receiving layer transferee. Seconds the dye is thermal transferred to the transferred dye receiving layer from a dye transferer such as an ink sheet, so that an image is formed. Last, the dye receiving layer on which the image has been formed on the intermediate record support is re-transferred to a (final) image receiver such as paper, i.e., in this method, the image is re-transferred. The second re-transfer recording method does not cause the problems which are caused in the first re-transfer recording method, since the dye receiving layer supporting sheet is not directly used so as to form the image.

When the method in which the drum is used as the intermediate record support forming the closed loop (the method disclosed in Japanese Patent Kokai Publication No.4-156384) is employed in the second re-transfer recording method, the intermediate record support can move speedily and with stability. However, when the dye receiving layer on which the image has been recorded is re-transferred to the final image receiver in the method in which the drum is used, the dye receiving layer, such as paper, should be heated from its back surface (i.e., a surface which is opposite to a surface with which the drum contacts) or a drum as the intermediate record support should be heated. Therefore, it is difficult to control the heat upon re-transferring the dye receiving layer on which the image has been recorded to the image receiver, so that there is a problem in that it is difficult to re-transfer with stability.

In contrast, when the method in which the belt is used as the intermediate record support forming the closed loop (the method disclosed in Japanese Patent Kokai Publication No.8-67016) is employed, a heating roller or a halogen lamp can be provided inside the belt which forms the closed loop as a heating source so as to re-transfer the dye receiving layer, on which the image has been formed, to the image receiver. Therefore, since the dye receiving layer on which the image has been recorded can be re-transferred by heating the belt and not by heating the image receiver, it can be relatively easy to control heat for re-transferring. However, it is difficult to control meandering of the belt, so that there is a problem in that speedy and stable thermal transfer of the recording image is difficult. Particularly, the belt as the intermediate record support moves is an unstable fashion. Since the image receiving layer is transferred onto such a belt and the image is thermal transfer recorded on the dye receiving layer on such a belt, it is conceived that versatility of the second re-transfer recording method may be reduced. Further, the halogen lamp, etc. is used as the heating source inside the belt. Therefore, it is conceived that since it is difficult to control a temperature of the surface of the belt, the versatility of the second re-transfer recording method may be reduced.

SUMMARY OF INVENTION

The present invention has been completed in order to solve the above problems. An object of the present invention is to provide a novel thermal transfer recording apparatus (such as a thermal transfer printer) for thermal transfer recording and a novel thermal transfer recording method (such as a thermal transfer printing method) which alleviate or substantially solve at least one of the problems in that a recording speed of an image is low, a stability of recording is poor, and a running cost of recording is high when the thermal transfer recording is carried out while recording a glossy and high quality image preferably in a digital mode. The thermal transfer recording method of the present invention is preferably carried out by using the thermal transfer recording apparatus of the present invention.

In an aspect of the present invention, a novel thermal transfer recording apparatus is provided, which comprises:

- an intermediate record support which forms a closed loop and extends over a plurality of drums which are placed separately,
- a dye receiving layer transfer section having a dye receiving layer transfer head which faces to a part of the intermediate record support on an outer periphery of one drum of the plurality of the drums,
- an image recording section having at least one image recording head which faces to a part of the intermediate record support on the outer periphery of the one drum, and
- an image transfer section having an image transfer head which faces to the intermediate record support inside of the closed loop.

According to the present invention, the intermediate record support extends over the plurality of the drums (for example, two or more drums) which are placed separately so as to form the closed loop. Therefore, a portion of the outer periphery of each of the plurality of the drums spaced separately contacts with a portion of the intermediate record support (which corresponds to the above parts of the intermediate record support). That is, each of the portions of the intermediate record support is positioned around each of such portions of the peripheries. As to the drum on which the part of the intermediate record support is positioned while the image recording head faces the intermediate record support, the intermediate record support is positioned around, preferably, not less than half of the whole outer periphery and, more preferably, not less than two thirds of the whole outer periphery of the drum.

The "dye receiving layer transfer section" herein is a region in which a dye receiving layer is transferred to the intermediate record support by heating a dye receiving layer transferee. More concretely, in the "dye receiving layer transfer section", the dye receiving layer transferer is heated by the image receiving layer transfer head while being pressed to and contacted with the intermediate record support, so that the dye receiving layer of which its adhesive property has been enhanced moves from the dye receiving layer transferer to the intermediate record support.

The "image recording section" is a region in which a dye tranferer is heated and a dye is thermally transferred to the dye receiving layer which has been transferred onto the intermediate record support, so that an image is formed on the dye receiving layer. More concretely, in the "image recording section", the dye transferer is heated by the image recording head while being pressed to and contacted with the dye receiving layer which has been transferred onto the intermediate record support, so that the dye moves from the dye transferer to the dye receiving layer (i.e., the dye thermally transfers) and the image is formed through the thermal transfer recording. It is noted that the "dye transferer" is a medium which includes a dye layer containing the dye to form the image.

The "image transfer section" is a region in which the intermediate record support is heated, so that the dye receiving layer on which the image has been recorded is re-transferred to an image receiver. More concretely, in the "image transfer section", the dye receiving layer on which the image has been formed is heated by the image transfer head while being pressed to and contacted with the image receiver, so that the dye receiving layer of which its adhesive property has been enhanced is transferred to the image receiver. It is noted that the "image receiver" can be said to be a "final image receiver".

In the thermal transfer recording apparatus of the present invention, by driving at least one drum of the plurality of the drums which are placed separately, the intermediate record support which constructs the closed loop moves and circulates along the closed loop which is formed by the outer peripheries of the plurality of the drums. The dye receiving layer transfer section, the image recording section and the image transfer section are arranged in series in the listed sequence along the moving (or running) direction of the intermediate record support.

When a term "upper reach (or upstream)" or a term "lower reach (or downstream)" is used in the present specification, those terms are based on the moving direction of the intermediate record support. Therefore, a direction from which the intermediate record support comes is called "upper reach", and a direction toward which the intermediate record support goes is called "lower reach". Thus, in the thermal transfer recording apparatus of the present invention, the dye receiving layer transfer section, the image recording section and the image transfer section are arranged in such a listed sequence from the upper reach to the lower reach.

Furthermore, in the present specification, when a term "transfer" is used, the "transfer" means that the dye receiving layer of the dye receiving layer transferer is moved to the intermediate record support by heating the dye receiving layer transferee.

Further, the "thermal transfer" or the "thermal transfer recording" means that the dye transferer (or dye thermal transferer) is heated, so that the dye is moved to the dye receiving layer on the intermediate record support, whereby the image is formed (recorded or printed) on the dye receiving layer.

In addition, the "re-transfer" means that the dye receiving layer on which the image has been recorded is heated, so that the dye receiving layer moves from the intermediate record support to the (final) image receiver.

In a further aspect of the present invention, a thermal transfer recording method is provided. The method of the present invention is characterized in that it comprises:

- a dye receiving layer transfer step in which the dye receiving layer is transferred onto the intermediate record support by heating a back surface of the dye receiving layer transferer in the dye receiving layer transfer section,
- an image recording step in which the dye is transferred to the dye receiving layer on the intermediate record support by heating a back surface of the dye transferer in the image recording section, so that the image is thermal transfer recorded, and
- an image transfer step in which the dye receiving layer on which the image has been recorded is re-transferred to the (final) image receiver by heating a back surface of the intermediate record support in the image transfer section.

The dye receiving layer transfer step is carried out by using the dye receiving layer transfer head which is placed so as to face (a part of) the intermediate record support which is located on the drum and forms the closed loop. The image recording step is carried out by using the image recording head which is placed so as to face (a part of) the intermediate record support which is positioned on the drum and forms the closed loop. Moreover, the image transfer step is carried out by using the image transfer head which is placed in the inside of the closed loop. The method is carried out, preferably, by using the apparatus such as a thermal transfer recording apparatus according to the present invention as described above.

More concretely, the method of the present invention is carried out as follows.

In the dye receiving layer transfer step, the dye receiving layer transferer which provides the dye receiving layer is supplied from a source thereof, and the dye receiving layer is heated by the dye receiving layer transfer head while being pressed to the intermediate record support, so that the dye receiving layer becomes in a condition of adhering to the intermediate record support. Then, the dye receiving layer and the intermediate record support are cooled together while being maintained integrally. Thereafter, the image receiving layer transferer is separated from the intermediate record support, and preferably separated at an angle not smaller than a given angle, so that the dye receiving layer alone is left on the intermediate record support, and thereby the dye receiving layer is transferred to the intermediate record support.

In the image recording step, the dye transferer which provides the dye layer is supplied from a source thereof, and the dye layer is heated by the image recording head while being pressed to the dye receiving layer on the intermediate record support, so that the dye contained in the dye layer moves to the dye receiving layer on the intermediate record support and the image to be formed by the dye is printed. Then the dye transferer and the intermediate record support are cooled together while being maintained integrally. Thereafter, the dye transferer is separated from the intermediate record support, so that the image receiving layer alone is left on the intermediate record support, and thereby the image is formed. An image is formed by using a next dye in a method similar to the above described method on the dye receiving layer which already has the image formed as described above, when an image is formed by using a plurality of dyes in sequence.

In the image transfer step, the image receiver is supplied from a source thereof, the image receiver is heated by the image transfer head while being pressed to the image receiving layer on the intermediate record support, so that the dye receiving layer on the intermediate record support attaches to the image receiver. Then, the image receiver and the intermediate record support are cooled together while maintained integrally. Then, the intermediate record support is separated from the image receiver, so that the dye receiving layer is left on the image receiver and thereby the image is re-transferred on the image receiver.

In a further aspect of the present invention, the intermediate record support which is used for the thermal transfer recording apparatus or thermal transfer recording method as described above is provided.

Both of the dye receiving layer transfer head and the image recording head face to the intermediate record support on the outer periphery of the drum from the outside of the closed loop and the image transfer head faces the intermediate record support from the inside of the closed loop. As a result thereof, as to recording the glossy and high quality image, the present invention provides the thermal transfer recording apparatus and the thermal transfer recording method which alleviate at least one of the problems in that the thermal recording speed of the image is low, the stability of the recording is poor, and the running cost of the recording is high.

DETAILED DESCRIPTION OF THE INVENTION

Figure 1:
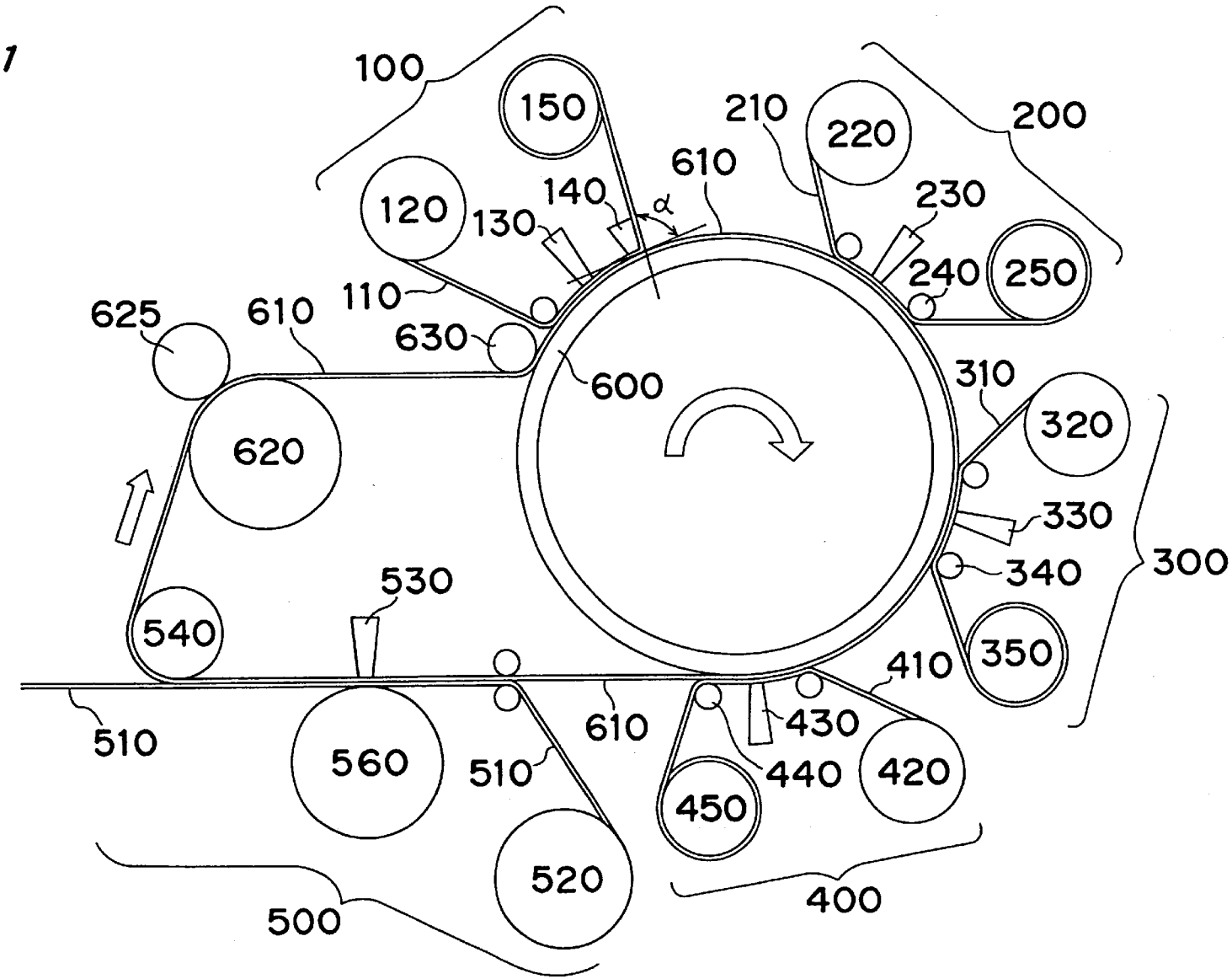
FIG. 1 shows an embodiment of a thermal transfer recording apparatus according to the present invention.

In the thermal transfer recording apparatus according to the present invention, an intermediate record support which forms a closed loop (or an endless loop) extends over a plurality of drums which are placed separately from each other (therefore, parts of the closed loop, which is formed by the intermediate record support, are in the plane contact condition with parts of the outer peripheries of the plurality of drums which are separately placed), both a dye receiving layer transfer head and an image recording head face, from the outside of the closed loop, to the intermediate record support on the outer periphery of one drum, and an image transfer head faces the intermediate record support from the inside of the closed loop.

In the thermal transfer recording apparatus of the present invention, the intermediate record support which forms the closed loop moves (or runs) and circulates around the plurality of drums which are separately placed, so that the dye receiving layer which has been transferred onto the intermediate record support in the dye receiving layer transfer section is moved to the image recording section where the image is thermal transfer recorded on the dye receiving layer, and the dye receiving layer on which the image has been recorded in the image recording section is re-transferred to the (final) image receiver in the image transfer section.

The image recording section may comprise a single image recording head when the image is printed (recorded) by using a single dye transferee, for example when the image is printed with a single color (i.e., when the image is formed with gradation of the single color) or when various coloring dye layers are formed in series on a single dye transferer (i.e., when dye layers of three primary colors of Y (yellow), for M (magenta) and for C (cyan) are formed repeatedly in sequence) as described in the following. In the latter case, when the formation of the image with one color is finished, it is generally necessary to circulate the intermediate record support once and to place the same single image recording head at a starting position for the image recording in order to form an image with a next color.

When the images of the three primary colors (Y (yellow), M (magenta) and C (cyan)) are recorded using different dye transferers, respectively, the image recording section may comprise three image recording heads (i.e., an image recording head for Y (yellow), an image recording head for M (magenta) and an image recording head for C (cyan)) which face the intermediate record support around the same drum in sequence. In this case, the sections in which the images of Y (yellow), M (magenta) and C (cyan) are recorded are referred to as an image recording section for Y (yellow), an image recording section for M (magenta) and an image recording section for C (cyan), respectively. The image recording section comprises the image recording sections for Y, M and C.

In the above described embodiment, both of the dye receiving layer transfer section and the image recording section are arranged in the outside of the intermediate record support on the outer periphery of the same drum so that they face the support. In other embodiment, the dye receiving layer transfer section and the image recording section may be arranged at the outside of the intermediate record support on outer peripheries of different drums to which they face.

Therefore, in the other embodiment, the present invention provides a thermal transfer recording apparatus comprising:

an intermediate record support which forms a closed loop and extends over a plurality of drums which are placed separately, a dye receiving layer transfer section having a dye receiving layer transfer head which faces to a part of the intermediate record support on an outer periphery of one drum of the plurality of drums, an image recording section having at least one image recording head which faces to a part of the intermediate record support on an outer periphery of a drum which is different from the one drum, and an image transfer section having an image transfer head which faces the intermediate record support from an inside of the closed loop.

In the specification, the term "drum" means a cylindrical member of which its diameter is relatively larger than its length (or height). A term "roller" means a cylindrical member of which its diameter is relatively smaller than its length (or height). However, these terms are not strictly distinguished in the field related to the present invention, which is applicable to the specification in a similar fashion.

However, in the specification, a drum is called as a "larger diameter drum" in principle, and the image recording section is arranged so as to face the intermediate record support on the outer periphery of the larger diameter drum, and the other drum(s) is referred to as a "smaller diameter drum(s)" or a "roller(s)" in principle. This is based on the fact that the "drum" around which the image recording section is arranged so as to face the intermediate record support on the outer periphery of the drum usually has a larger diameter than the other drums. For convenience's sake, the other drums are referred to as the "smaller diameter drums" or the "rollers".

There is no particular limitation as to the size of the larger diameter drum. However, the diameter thereof is preferably in the range of 80–250 mm from a viewpoint of downsizing of the apparatus and arrangement of the image recording section therein.

When both the image receiving layer transfer section and the image recording section are placed so as to face to the intermediate record support on the outer periphery of the same one drum, and the image recording section comprises the single image recording head, the diameter of the larger diameter drum is preferably in the range of 80–150 mm and more preferably in the range of 100–130 mm.

When both the image receiving layer transfer section and the image recording section are placed so as to face the intermediate record support on the outer periphery of the same one drum, and the image recording section comprises the image recording section for Y, the image recording section for M and the image recording section for C, the diameter of the larger diameter drum is preferably in the range of 150–250 mm and more preferably in the range of 180–220 mm.

When the dye receiving layer transfer section and the image recording section are arranged so as to face the outside of the intermediate record support on the outer peripheries of the different drums to which those two sections facet respectively, and the image recording section comprises the single image recording head, the diameter of the smaller diameter drum which is arranged so as to face to the intermediate record support on the outer periphery of the smaller diameter drum is preferably in the range of 40–70 mm, and more preferably in the range of 50–60 mm. The diameter of the larger diameter drum is preferably in the range of 80–150 mm, and more preferably in the range of 100–130 mm.

When the dye receiving layer transfer section and the image recording section are arranged so as to face to the outside of the intermediate record support on the outer peripheries of the different drums to which those two sections face respectively, and the image recording section comprises the image recording section for Y, the image recording section for M and the image recording section for C, the diameter of the smaller diameter drum, which is arranged around so as to face the intermediate record support on the outer periphery of the smaller diameter drum, is preferably in the range of 40–70 mm and more preferably in the range of 50–60 mm. The diameter of the larger diameter drum is preferably in the range of 120–180 mm and more preferably in the range of 140–160 mm.

When the dye receiving layer transfer section and the image recording section are arranged so as to face to the outside of the intermediate record support on the outer peripheries of the different drums to which those two sections are opposed, respectively, controlling the dye receiving layer transfer step in which the dye receiving layer is transferred onto the intermediate record support in the dye receiving layer transfer section is independent of controlling the image recording step in which the image is recorded on the dye receiving layer in the image recording section, which is preferable. Moreover, the above arrangement is more preferable since a cold-releasing distance can be ensured wherein the dye receiving layer transferer which is bonded to the intermediate record support by heating in the dye receiving layer transfer section is cooled enough before the dye receiving layer is released as described below. Furthermore, since the diameter of the larger diameter drum can be optimized, the larger diameter drum can be driven in a more stable fashion, so that the image can be recorded in a more stable fashion, which is more preferable.

The "recording temporary support" in the present invention is a belt-form (or belt-like) medium which forms the closed (endless) loop wherein the dye receiving layer is heated and transferred onto the support, the image is thermal transfer recorded on the dye receiving layer on the support which has been thus transferred, and the dye receiving layer on which the image has been thus recorded is re-transferred from the support to the (final) image receiver. There is no particular limitation on the intermediate record support so long as it is thermally and mechanically strong.

The intermediate record support forms the endless closed loop in the present apparatus, and it comprises a substrate which forms an endless loop.

There is no particular limitation on the "substrate" for the intermediate record support so long as it is thermally resistant and mechanically stable.

Such a substrate may be made of a heat resistive film such as a polyimide film, an aramid film, a polyetherether-ketone (PEEK) film or a polyphenylenesulfide (PPS) film.

The substrate thickness is preferably in the range of 12–50 μm, and more preferably in the range of 25–40 μm. In particular, the polyimide film of which its thickness is in the range of 25–50 μm is preferable.

A commercially available product can be used as the above substrate.

Examples of the polyimide film include so-called ordinary grade films (such as Captone 100H (trade name) manufactured by Toray-Du Pont Co., Ltd.). A thermally and mechanically more stable polyimide film is preferred.

As such a polyimide film, one having small heat shrinkage ratio and elongation is particularly preferred.

"Heat shrinkage ratio" in the present specification means a value which is determined according to the method described in ASTM D-1204. The heat shrinkage ratio of the polyimide film is preferably not more than 0.3%, more preferably not more than 0.1%, and particularly preferably not more than 0.05%.

"Elongation" in the present specification means a value which is determined according to the method described in ASTM D-882. The elongation of the polyimide film is preferably not more than 80%, more preferably not more than 70%, and particularly preferably not more than 60%.

Examples of the polyimide film of which both heat shrinkage ratio and elongation are excellent and which has a thickness of 25 μm includes Captone 100V and 100EN (trade names) manufactured by Toray-Du Pont Co., Ltd. and UPILEX 25S (trade name) manufactured by Ube Industries, Ltd. Captone 100EN manufactured by Toray-Du Pont Co., Ltd. is particularly preferred. Captone 100EN manufactured by Toray-Du Pont Co., Ltd. has a heat shrinkage ratio of 0.02% and Captone 100H manufactured by Toray-Du Pont Co., Ltd. has a heat shrinkage ratio of 0.3%. Therefore, Captone 100EN manufactured by Toray-Du Pont Co., Ltd. has a rather excellent heat shrinkage ratio. Moreover, Captone 100EN manufactured by Toray-Du Pont Co., Ltd. has an elongation of 57% and Captone 100H manufactured by Toray-Du Pont Co., Ltd. has an elongation of 80%. Therefore, Captone 100EN manufactured by Toray-Du Pont Co., Ltd. also has a rather excellent elongation.

Furthermore, such a polyimide film having a small contact angle is more preferable.

The "contact angle" in the specification is a value which is determined with respect to water by using a contact angle measuring apparatus of FACE CA-Z type manufactured by Kyowa-Kaimen-Kagaku Co., Ltd. The polyimide film has a contact angle preferably of not more than 55 degrees, more preferably of not more than 40 degrees, and particularly preferably of not more than 30 degrees.

The above mentioned polyimide film has a contact angle of 55 degrees just after the production of the film. However, the polyimide film can be changed so as to have a contact angle of not more than 40 degrees by a treatment of the film such as a plasma treatment and a corona treatment. The polyimide film is preferably used after the polyimide film is modified by a treatment to provide an improved adhesive property such as the plasma treatment and the corona treatment etc.

Further, after the production of the above described polyimide film, heat stability of the film can be improved by, for example, annealing the film at a temperature of not less than 200° C. (for example, maintaining the film at a given temperature of not less than 200° C. for a predetermined period). The film which has been improved by such a treatment is d preferably used.

The "substrate" for the intermediate record support (i.e., the closed loop substrate) can be prepared by connecting both end portions of the belt-form or elongated strip-like "substrate" for the intermediate record support as described above in an appropriate method. There is no particular limitation on the connecting method so long as the connection part which is obtained by the method has both excellent heat resistance and mechanical stability. For example, the closed loop substrate can be prepared, e.g., by connecting both end portions of the above described "substrate" by using a heat resistive adhesive tape such as a polyimide based adhesive tape.

Examples of such a closed loop substrate include a closed loop substrate which is prepared by connecting both end portions of a polyimide film strip by the polyimide based adhesive tape. A commercially available polyimide based adhesive tape can be used. For example, polyimide based adhesive tapes 360pc, 360A and 360R manufactured by Nitto Denko Co. are exemplified.

An outer surface of the "closed loop substrate" for the intermediate record support which is obtained as described above may be roughened by the shape effect. Being roughened by the shape effect means that the surface is in a microscopically rough condition. When the substrate has such a surface, there is provided an excellent effect in that an adhesion between the substrate and the dye receiving layer is increased.

Moreover, the intermediate record support may have a functional layer on the outside of the closed loop substrate (i.e., on a side opposite to a side which contacts with the larger diameter drum). The "functional layer" functions to make it easy for the intermediate record support to receive the dye receiving layer, to protect the closed loop substrate and to improve sensitivity of the image recording. It is noted that the outside of the closed loop substrate is also referred to as a "front surface", and the inside of the closed loop substrate is also referred to as a "back surface".

The functional layer is preferably thermally insulative, more preferably flexible, and particularly preferably thermos table.

Examples of such a functional layer include a layer containing at least one rubber selected from a fluororubber and a silicone rubber. The layer preferably has a thickness in the range of 5–30 μm.

A fluororubber of a tercopolymer of vinylidene fluoride, hexafluoropropylene and tetrafluoroethylene (biton) is preferred as the fluororubber. Moreover, a polytetrafluoroethylene, a copolymer of tetrafluoroethylene and perfluoroalkyl vinyl ether, a fluororesin based on vinyliden fluoride and hexafluoropropylene, and a so-called fluorine containing rubber and so on are also preferred.

A silicone rubber of which film can be prepared by addition polymerization or condensation polymerization and which is used for various coatings, releasing paper and adhiesives, for example, is preferred.

For example, these rubbers preferably contain at least one kind of fine particles selected from carbon and magnesium oxide.

In order to improve the sensitivity of the image recording, the above described functional layer is preferably in a two layered structure, wherein one layer which is in contact with the outside of the closed loop substrate (i.e., a layer adjacent to the front surface) is formed as a porous layer (a lower layer) and the other layer is formed on the lower layer as a less porous layer (an upper layer) in comparison with the lower layer.

When the functional layer having such two layered structure is formed, for example, by using the above mentioned fluororubber, the functional layer preferably comprises a porous lower layer and a smooth upper layer wherein the lower layer contains a fluororubber including a lot of fine particles of, for example, carbon and the upper layer contains a fluororubber including less fine particles than the fluororubber for the lower layer.

Thus, it is preferable that the functional layer comprises the fluororubber and it includes a thermally insulative and porous portion. Moreover, the porous portion of the functional layer is preferably a portion which contacts with the front surface of the closed loop substrate.

Furthermore, the intermediate record support may comprise a heat-resistant sliding layer on the inside of the closed loop substrate (i.e., on the back surface of the closed loop substrate).

The "heat-resistant sliding layer" means a layer to protect the closed loop substrate from deformation caused by heat of the image transfer head of the image transfer section and to provide a sliding ability to the image transfer head which contacts with the heat-resistant sliding layer, so that the abrasion of the image transfer head and the damage of the substrate of the intermediate record support are prevented. Generally, the heat-resistant sliding layer is preferably similar to a heat-resistant sliding layer which is used for the dye receiving layer transferer as described later.

At least one drum is driven and rotated, so that the intermediate record support is moved and circulated by means of a frictional force between the drum and the intermediate record support. Usually, the intermediate record support is moved by driving the larger diameter drum. Another one or more drums (the smaller diameter drums or rollers) may be driven in addition to the larger diameter drum, so that the drive of the larger diameter drum may be assisted.

The sprocket wheel and sprocket hole manner (or mode) (henceforth, also referred to as a "sprocket manner (or mode)") may be additionally used for driving the intermediate record support. In this case, the sprocket holes are provided along both of the edge portions of the intermediate record support. In this case, strength of the intermediate record support is preferably improved by duplicating both edge regions of the closed loop substrate having the sprocket holes.

Moreover, various widths of the intermediate record support as described above can be selected depending on the size of the image to be recorded. Such width preferably corresponds to the width of the "drum".

Furthermore, the thermal transfer recording apparatus of the present invention may comprise an additional "drum", if necessary (particularly in order to move the intermediate record support smoothly). The additional "drum" contacts with the closed loop of the intermediate record support, and a part of the outer periphery of the additional "drum" forms a part of the closed loop of the intermediate record support. The additional "drum" may be one or plural, and may include a so-called "roller" (or guide roller).

At least one drum, preferably the larger diameter drum, of which outer periphery contacts with a part of the closed loop of the intermediate record support comprises an elastic member having a rubber hardness in the range of 60–70 degrees around the circumference of the surface. The drum is driven with a driving apparatus which is linked with the drum comprising the elastic member around the surface, so that the intermediate record support is moved by the drum. This drive is referred to as a main drive and the drive section for the main drive is referred to as a main drive section.

Furthermore, the intermediate record support may be driven using a driving apparatus which transmits a force to another drum of which outer periphery forms a part of the closed loop of the intermediate record support. By this driving apparatus, auxiliary drive for the intermediate record support is carried out. The drive section for the auxiliary drive is referred to as an auxiliary drive section. The intermediate record support can be driven more smoothly through the combination of the main drive with the auxiliary drive.

A main driving force for the intermediate record support is provided as a friction force between the elastic member of the drum and the back surface of the intermediate record support. It is noted that when a peripheral speed (or a speed of the outer periphery) of the auxiliary drive is faster than that of the main drive, the intermediate record support is driven stably, even if a large tension is applied to the intermediate record support.

Furthermore, a driving mechanism which is called a sprocket manner (or mode) as described above may be additionally used to drive the intermediate record support. Protruding portions (i.e., sprockets) which engage with sprocket holes which can be provided with the above described recording temporary support are formed around a periphery of the drum along both of its edge portions which drum the elastic member is provided with and which drum is used for the main drive. Therefore, the drum which is used for the main drive has the elastic member such as a rubber having a rubber hardness of 60–70 degrees around the periphery of the drum except for the both edge portions thereof.

In the sprocket manner, the intermediate record support is driven by means of a driving apparatus which is linked with a main axis of the drum which the protruding portions are provided with. The main driving force of the intermediate record support is still the friction force between the elastic member on the surface of the drum and the back surface of the intermediate record support, but sliding between the elastic member and the back surface of the intermediate record support is surely prevented by using the protruding portions of the drum which engage with the sprocket holes of the intermediate record support. The mechanism of the sprocket holes and the protruding portions also functions as a meandering preventive mechanism.

When the sprocket manner is not used, it is not necessary to provide the intermediate record support with the sprocket holes or to provide the drum with the protruding portions. Therefore, both the width of the intermediate record support and the width of the drum can be narrowed by a width which corresponds to the sprocket holes and the protruding portions.

It is noted that the drum which is used for the above main drive is preferably the larger diameter drum and the drum which is used for the auxiliary drive is preferably a smaller diameter drum which also functions as a releasing roller in the image transfer section as described below.

The dye receiving layer transfer section comprises the dye receiving layer transfer head, and moreover preferably comprises a cold-releasing mechanism for the dye receiving layer transferee, a rewinding section and a winding section for the dye receiving layer transferee. The dye receiving layer transfer head is positioned outside the intermediate record support on the outer periphery of the larger diameter drum or the smaller diameter drum as described above.

In the dye receiving layer transfer section, the dye receiving layer of the dye receiving layer transferer which is provided from the rewinding section is transferred on the intermediate record support by being pressed to the intermediate record support while heated from the back surface of the transferee, by being heated after being pressed to the intermediate record support, or by being pressed to the intermediate record support after being heated by the dye receiving layer transfer head.

An edge-face head is used as the dye receiving layer transfer head. For example, a commercially available edge-face head for image recording (resolution of 300 dpi) can be used. More concretely, a line recording head having a resolution of 300 dpi is preferably used. Further, a C-shaped edge-face head described below may be used.

In the present specification, the "edge-face head" means a heating means which can effectively press wherein a convex glaze is formed on a thickness dimension part of a ceramic substrate having a thickness of about 1 mm, and a heater array is formed on the center part in the convex glaze. Each of fine heater elements which form the heater array can be heated independently. Therefore, a specific heater element(s) alone in the heater array can be heated, so that only the part(s) to be heated can be heated more surely and precisely in comparison with the prior heating methods using, for example, a heating roll or a heating press and so on. The above is similarly applicable to head(s) other than the dye receiving layer transfer head. A head which is called a thermal head or a thermal transfer head and which is widely used in the thermal transfer type printers and facsimiles, etc. can be used as the heads in the present invention.

Since the dye receiving layer is transferred onto the intermediate record support on the drum using the "edge-face head" as the dye receiving layer transfer head, it is easy to control heat to be applied when the dye receiving layer is transferred, so that the dye receiving layer can be transferred more stably. A "C-shaped edge-face head" in which a heating array is formed on a C-shaped edge-face surface (C-shaped edge-face portion of surface connection) of the ceramic substrate may be used in place of the "edge-face head". Such a head is advantageous since its pressing force can be enlarged relative to the conventional "edge-face head".

The "cold-releasing mechanism for the dye receiving layer transferer" means a mechanism in which the dye receiving layer attaching attached to the intermediate record support through heating with the dye receiving layer transfer head is cooled integrally in such an attached state, and then the dye receiving layer transferer is released from the intermediate record support preferably at an angle not less than a certain angle. By such releasing, the dye receiving layer is left on the intermediate record support so that it is transferred. In order to carry out the transfer stably, it is important to cool the dye receiving layer and the intermediate record support enough in the cold-releasing mechanism. Such a cold-releasing mechanism may be a mechanism which can retain both the dye receiving layer and the intermediate record support (which move on the drum) for a predetermined period as they are integral. Concretely, the mechanism may be a roller or a press, etc. which is placed on the drum downstream the head. Such the cold-releasing mechanism is applicable to a case in which releasing is carried out after heating by the other head (such as an image recording head, and an image transfer head). A cold-releasing angle in the cold-releasing mechanism is preferably not less than 45 degrees, more preferably not less than 60 degrees, and particularly preferably not less than 90 degrees in order to transfer the dye receiving layer stably when the dye receiving layer is released from the intermediate record support in the cold-releasing mechanism. The above cold-releasing angle is also applied to another case when the dye receiving layer is released after it has been heated with other head.

When the dye receiving layer transferer is released from the intermediate record support on the outer periphery of the drum in the cold-releasing mechanism, with respect to an intersection line of the intermediate record support with a plane along which the dye receiving layer transferer is wound by the winding section for the dye receiving layer transferee, the "cold-releasing angle" is an angle formed by a plane which is tangent to the outer periphery of the drum with the plane along which the dye receiving layer transferer is wound into the winding section for the dye receiving layer transferer (an angle a indicated in FIG. 1 which is described below). On the other hand, when the dye receiving layer transferer is released from the intermediate record support which is not on the outer periphery of the drum in the cold-releasing mechanism, with respect to an intersection line of the intermediate record support with a plane along which the, dye receiving layer transferer is wound by the winding section for the dye receiving layer transferee, the "cold-releasing angle" is an angle formed by the intermediate record support with the plain along which the dye receiving layer transferer is wound by the winding section for the dye receiving layer transfer (an angle β displayed in FIG. 5 which is described below).

The dye receiving layer transferer comprises a "substrate" as a base and the dye receiving layer. The substrate supports the dye receiving layer which is formed on the front surface of the substrate. There is no particular limitation on the "substrate" for the dye receiving layer transferer so long as it is mechanically strong, elastic, heat resistive, and solvent resistive as a base. A substrate which is equivalent to a "substrate" for the dye transferer as described below can be used as the "substrate" for the dye receiving layer transferee.

A plastic film such as a polyester film, a polycarbonate film, a polyamide film and a polyimide film is preferably exemplified and they preferably have a thickness in the range of 6–12 μm. The polyester film having a thickness of in the range of 6–12 μm is particularly preferable.

Commercially available films can be used as the substrate.

It is noted that a "front surface" of the substrate means a surface that the dye receiving layer transferer faces or contacts with the intermediate record support.

Considering a quality of the image which is formed on the dye receiving layer, a sensitivity of the dye receiving layer which receives the dye, easinesses of cutting and transfer of the dye receiving layer, and stability of adhesion of the dye receiving layer on the intermediate record support and so on, the "dye receiving layer" of the dye receiving layer transferer is formed using a composition which can form such the dye receiving layer. There is no particular limitation on the "dye receiving layer" so long as it complies with the above properties. It is noted that the "easiness of cutting" means an extent to which only a predetermined part of the dye receiving layer on the substrate of the dye receiving layer transferer remains on the intermediate record support easily (therefore, only the predetermined part can substantially be cut off), when such part is heated so that such part alone is attached to and unified with the intermediate record support as a single body, followed by releasing the dye receiving layer transferer (i.e., the substrate) after cooling the body.

Such the dye receiving layer is preferably formed from a composition comprising an acrylic polyol resin and the other thermoplastic resin. Moreover, the dye receiving layer is more preferably formed from a composition comprising the acrylic polyol resin and a plurality of the other thermoplastic resins. Additionally, a crosslinking agent and various additives may be added to the composition to form the dye receiving layer. A material to be applied (or coated) from which the dye receiving layer is formed is prepared using the above mentioned composition and a solvent which dissolves the composition. Such material to be applied is preferably uniform as a whole. Moreover, it is preferable that the acrylic polyol resin and the other thermoplastic resin(s) to form the dye receiving layer are compatible and capable of being homogeneous as a whole.

In general, an acrylic resin (including a methacrylic resin and a resin prepared by copolymerization of an acrylic monomer and a methacrylic monomer) which is excellent in its transparency has not been of interested hereto as a resin to form the dye receiving layer used for the thermal transfer recording. It seems that this is because the acrylic resin is poor in the dye receiving property that is an important characteristic which the resin to form the dye receiving layer is required to have. However, among the acrylic resins, the acrylic polyol resin which is an acrylic resin having a hydroxyl group has an improved dye receiving property depending on an amount of the hydroxyl group contained. Therefore, the acrylic polyol resin can be selected as the resin which, while maintaining a film strength of the image receiving layer, forms an image receiving layer of which transparency is excellent and of which dye receiving property is improved.

In the present specification, the "acrylic polyol resin" is a so-called acrylic resin having two or more hydroxyl groups in one molecule. An example thereof is an acrylic resin which is prepared by copolymerization of a (meth)acrylic monomer having a hydroxyl group with a (meth)acrylic ester. The acrylic polyol resin herein preferably has a hydroxyl value of not less than 30, more preferably in the range from 30 to 150, further more preferably in the range from 40 to 90, and particularly preferably about 50. Its glass transition temperature (Tg) is preferably in the range from 40 to 70° C., and more preferably in the range from 50 to 60° C.

A commercially available acrylic polyol resin may be used as the acrylic polyol resin.

In the present specification, the "other thermoplastic resin" refers to a resin which is capable of providing properties such as a dye receiving property and a dye solubility to the acrylic polyol resin and is also capable of improving the properties of the dye receiving layer by being used in combination with the acrylic polyol resin. Such "other thermoplastic resin" preferably is at least one selected from a polyester resin, a vinyl chloride-vinyl acetate copolymer resin (henceforth, sometimes referred to as "a vinyl chloride-vinyl acetate resin"), and a silicone resin. In addition, the "other thermoplastic resin" is preferably constituted of two or more kinds of resins selected from the polyester resin, the vinyl chloride-vinyl acetate copolymer resin, and the silicone resin.

The use of the polyester resin as the "other thermoplastic resin" is preferable because it improves the dye receiving property of the dye receiving layer. The "polyester resin" herein may be a so-called polyester resin. A low molecular weight polyester resin is preferable as the polyester resin. An upper limit of the number-average molecular weight (Mn) of the low molecular weight polyester resin is preferably 15,000, more preferably 10,000, and particularly preferably 6,000. A lower limit of the number-average molecular weight (Mn) of the low molecular weight polyester resin is preferably 2,000, more preferably 3,000, and particularly preferably 5,000. A range of the number-average molecular weight (Mn) of the low molecular weight polyester resin is preferably from 2,000 to 15,000, more preferably from 3,000 to 10,000, and particularly preferably from 5,000 to 6,000. In addition, the polyester resin is preferably a polyester polyol resin, whose hydroxyl value is preferably not less than 10, more preferably from 10 to 200, and particularly preferably from 10 to 70.

Moreover, a polyester resin having a skeleton such as bisphenol A skeleton is preferred because it provides the dye receiving layer with releasability from the dye layer during the thermal transfer recording (henceforth, referred to as "releasability"). Furthermore, a polyester resin having a skeleton which comprises maleic acid as an acid component and an adduct of ethylene glycol or propylene glycol with bisphenol A as a glycol component is particularly excellent.

Those polyester resins are preferable because they have enough compatibility with the acrylic polyol resin and provide a homogenized binary transparent resin layer containing the acrylic polyol resin and the polyester resin, which layer has a high dye receiving property and a high film strength.

A commercially available polyester resin may be used as such polyester resin.

It is noted that a typical (saturated linear) polyester resin (of which number-average molecular weight (Mn) is about 20,000 or more) is preferable in its good dye receiving property, but also has a problem of high tackiness. In addition, when the acrylic polyol resin and the typical (saturated linear) polyester resin are used together and compatibility between them is not sufficient, it may be difficult to form a smooth and transparent film.

However, even the above, such a typical (saturated linear) polyester resin (of which number-average molecular weight (Mn) is about 20,000 or more) can be used when it has a sufficient compatibility with the acrylic polyol resin. It can form a homogenized binary transparent resin layer with a high dye receiving property and a high film strength, and it has not-too-high tackiness.

The use of the vinyl chloride-vinyl acetate resin as the "other thermoplastic resin" is preferable because it improves the dye receiving property of the dye receiving layer. The "vinyl chloride-vinyl acetate resin" herein may be a so-called vinyl chloride-vinyl acetate resin. An additional monomer may be used in the polymerization for the vinyl chloride-vinyl acetate resin. As such, vinyl chloride-vinyl acetate resin, a vinyl chloride-vinyl acetate resin having a hydroxyl group at an end of a molecule is preferable. A vinyl chloride-vinyl acetate-vinyl alcohol copolymer is preferable. The vinyl chloride-vinyl acetate resin preferably has a glass transition temperature (Tg) in the range from 60 to 80°, and more preferably in the range from 65 to 75° C. In order to improve the image stability, a content of moieties derived from vinyl chloride in the vinyl chloride-vinyl acetate resin (a content of vinyl chloride in a monomer mixture when the vinyl chloride-vinyl acetate resin is obtained by polymerizing the monomer mixture) is preferably not more than 85% by weight, more preferably from 75 to 85% by weight, and particularly preferably from 80 to 82% by weight. The addition of the vinyl chloride-vinyl acetate resin to a compatible resin system of the acrylic polyol resin and the polyester resin can provide a ternary homogenious resin system which has further improved dye receiving property and releasability. In addition, the use of a vinyl chloride-vinyl acetate resin modified with a hydroxyl group is preferable since it can improve the dye receiving property and the releasability of the resin layer to be obtained.

It is particularly preferable that the vinyl chloride-vinyl acetate resin contains the moieties derived from vinyl chloride of not more than 85% by weight in the vinyl chloride-vinyl acetate resin, and is modified with a hydroxyl group at an end of the molecule thereof.

A commercially available vinyl chloride-vinyl acetate resin may be used as the vinyl chloride-vinyl acetate resin.

It is noted that the vinyl chloride-vinyl acetate resin is excellent in the dye receiving property, but it has a problem in the stability of images recorded by dyeing, so that it is not easy to use the vinyl chloride-vinyl acetate resin alone as the resin to form the dye receiving layer. Therefore, the resin has conventionally been used as an auxiliary resin to form the dye receiving layer.

The use of a silicone resin as the "other thermoplastic resin" is preferable since it improves flexibility of the dye receiving layer and releasability of the dye receiving layer from the dye layer transferee. The "silicone resin" may be a so-called silicone resin. As such a silicone resin, an alkyd-modified silicone resin, a polyester-modified silicone resin and an acryl-modified silicone resin are preferable since they can improve the dye receiving property and weather resistance. A modified silicone resin having a hydroxyl group or a methoxy group for modification can be added to the silicone resin as a film formability (leveling ability) modifier. The silicone resins are preferable because they can make a soft network in the dye receiving layer so as to provide a stable dye receiving layer which suffers from less degradation with aging and also they can improve the film formability (leveling ability) of the dye receiving layer.

A commercially available silicone resin may be used as the silicone resin.

When each of the resins which constitute the resin system in which the above silicone resin is added to the above binary or ternary compatible resin system has a hydroxy group, a flexible and tough dye receiving layer can be formed since a soft network is constituted throughout the whole of the formed dye receiving layer.

The dye receiving layer transferer preferably comprises the acrylic polyol resin having a hydroxy value of not less than 30, the polyester resin having the bisphenol skeleton, the vinyl chloride-vinyl acetate resin and the silicone resin.

In addition, the composition comprising the acrylic polyol resin(s) and the other thermoplastic resin(s) can contain a crosslinking agent. The addition of the crosslinking agent to the composition to form the dye receiving layer can provide a high speed recording property (or a high temperature recording property: an image can be recorded more rapidly since it can be recorded at a high temperature) with the obtained dye receiving layer, since the crosslinking agent can form a crosslinking structure within the acrylic polyol resin(s) itself (themselves), and if possible (that is, when the other resin(s) contains a hydroxy group), between the acrylic polyol resin and the other thermoplastic resin(s) and/or between the other thermoplastic resin(s) itself (themselves), so that a partly crosslinked resin system is constructed.

As the "crosslinking agent", a typical polyisocyanate compound (which has two or more isocyanate groups (–NCO) in one molecule) can form a transparent, tough and flexible crosslinked film, since the polyisocyanate compound reacts with a polyol, etc. and forms a urethane bond in the film of the dye receiving layer.

An amount of the polyisocyanate compound is preferably from 0 to 5 parts by weight, and more preferably from 0 to 2 parts by weight, based on 100 parts by weight of the sum of the acrylic polyol resin and the otherthermoplastic resin.

A commercially available polyisocyanate compound can be used as the polyisocyanate compound. Specific examples of the polyisocyanate compound include Colonate L (trade name) manufactured by NIPPON POLYURETHANE INDUSTRY CO., LTD which is an ethyl acetate solution of a polyisocyanate compound which is obtained from tolylenediisocyanate (TDI) and a multi-functional alcohol, and Colonate HX (trade name) manufactured by NIPPON POLYURETHANE INDUSTRY CO., LTD which is obtained using hexamethylenediisocyanate (HDI) as a raw material.

Moreover, the compositions to form the dye receiving layer which contains the acrylic polyol resin and the other thermoplastic resin can contain various kinds of additives which are conventionally included in the dye receiving layer in order to make the dye receiving layer which possesses desired properties. Examples of such additives include a resin-compatibility-dispersion accelerator, a releasing agent, various light stabilizers, an ultraviolet absorber, a quencher and an antioxidant, etc.

The "resin-compatibility-dispersion accelerator" means an agent for improving the compatibility of the acrylic polyol resin with the other thermoplastic resin(s). The "releasing agent" means an agent which is capable of providing the image receiving layer with the releasability. Examples of the resin-compatibility-dispersion accelerator and/or the releasing agent include a higher fatty acid ester and a silicone oil modified with a higher fatty acid, etc. As the higher fatty acid ester, for example, an alcohol ester of a higher fatty acid such as butyl stearate and an alcohol ester of a polybasic acid having a hydroxyl group can be used.

A commercially available resin-compatibility-dispersion accelerator and a commercially available releasing agent can be used as the resin-compatibility-dispersion accelerator and the releasing agent.

The addition of the various light stabilizers, the ultraviolet absorber, the quencher and the antioxidant, etc can improve the stability of the image on the dye receiving layer. A hindered amine based stabilizer (HALS) is preferable as the light stabilizer. A combination of a salicylic acid-based ultraviolet absorber, a benzophenone-based ultraviolet absorber and a benzotriazole-based ultraviolet absorber is preferable as the "ultraviolet absorber (UVA)". The benzotriazole-based ultraviolet absorber is particularly preferable as UVA.

A commercially available light stabilizer, a commercially available ultraviolet absorber, a commercially available quencher and a commercially available antioxidant can be used as the light stabilizer, the ultraviolet absorber, the quencher and the antioxidant.

The dye receiving layer may be formed by a single layer alone and by two layers or more as required, so that functions of the dye receiving layer can be separated. When the dye receiving layer is constituted by the two layers, a resin having higher surface energy than a resin to form an under layer is used as a resin to form an over layer. Considering based on the composition to form the above dye receiving layer, an amount of the polyester resin is increased in the over layer and an amount of the vinyl chloride-vinyl acetate resin is increased in the under layer, so that a difference of the surface energy between the over layer and the under layer can be provided. By this, the transfer of the dye receiving layer onto the intermediate record support and the stability of the thermal transfer recording of the dye are further improved.

The dye receiving layer transferer can be produced by using a method which is the same as the known method. For example, the dye receiving layer transferer can be produced by adding a solvent capable of dissolving the above composition for forming the dye receivimg layer to the composition in order to prepare a material to be applied (or coated), applying the material onto a front surface of a substrate which is used for the dye receiving layer transferee, and then drying the applied material to form the dye receiving layer transferee.

The dye receiving layer has preferably a thickness in the range of 5–9 $\mu$m.

The dye receiving layer which is formed as described above may preferably be cut in an arbitrarily predetermined shape and transferred onto the intermediate record support by the dye receiving layer transfer head.

Moreover, the dye receiving layer transferer preferably comprises a heat-resistant sliding layer on a back surface of its substrate.

The "heat-resistant sliding layer" means a layer provided in order to avoid the deformation of the "substrate" of the dye receiving layer transferer which deformation is caused by heat applied by the dye receiving layer transfer head in contact with the back surface of the substrate, and in order to smooth the running of the dye receiving layer transferee on the heating means by controlling simultaneously both the heat resistance and a coefficient of friction of the substrate.

As the "heat-resistant sliding layer" of the dye receiving layer transferee, a layer which is similar to the "heat-resistant sliding layer" of the dye transferer as described below may be used.

In general, the "heat-resistant sliding layer" can be formed by using a composition to form the heat-resistant sliding layer on the back surface of the dye transferer (see, Japanese Patent No. 2,670,539, and Japanese Patent Kokai Publication No. 59-225994, etc.). Examples of the composition to form the heat-resistant sliding layer includes a crosslinkable resin composition in which fine particles such as talc and silica and various silicone oils. etc. are added to an acrylic polyol resin, a plastic resin and a crosslinking agent. The heat-resistant sliding layer preferably has a thickness in the range of 0.5–1.5 $\mu$m, and particularly preferably a thickness of about 1 –m.

Therefore, the dye receiving layer transferer preferably comprises the heat-resistant sliding layer on the back surface of the substrate and the dye receiving layer which can be cut off in the arbitrarily predetermined shape and transferred onto the intermediate record support by the dye receiving layer transfer head.

The image recording section comprises the image recording head and furthermore comprises a cold-releasing mechanism, as well as a rewinding section and a winding section for the dye transferee. The dye transferer is supplied by the intermediate record support from the rewinding section for the dye transferee, the dye transferer is temporarily unified with the dye receiving layer by being pressed to the dye receiving layer on the intermediate record support between the image recording head and the larger diameter drum and by being heated with the image recording head. Then, after the dye transferer is cooled by the cold-releasing mechanism, the dye transferer preferably releases from the dye receiving layer when the dye transferer is wound by the winding section.

As described above, when printing with a single color is carried out or the dye transferer in which the different dye layers are formed in series is used, the image recording section may comprise a single image recording head alone. The image recording section may comprise the image recording section for Y (yellow), the image recording section for M (magenta), and the image recording section for C (cyan) in which each of the three primary colors, Y, M and C is recorded respectively in series at a different position around the larger diameter drum.

When the image recording section comprises the image recording section for Y, the image recording section for M, and the image recording section for C, the image recording sections for Y, M and C are positioned in tandem and face to the intermediate record support on the outer periphery of the same one drum. A spacing between two adjacent image recording sections for Y, M and C is preferably equal to or larger than an intended image recording size, moreover the spacings are preferably the same. As to the spacing between the image recording sections for Y, M and C, for example, when the image recording size is an A6 size which is placed transversely, the spacing between two adjacent image recording heads for Y, M and C is preferably about 110 mm.

Further, each of the image recording heads for Y, M and C is provided and faces to the intermediate record support on the outer periphery of the drum. The image recording heads for Y, M and C are positioned preferably separately by the same spacing.

An edge-face head is used as the image recording head as in used for the dye receiving layer transfer head as described above. For example, a commercially available edge-face head (resolution 300 dpi) for image recording can be used as the image recording head as in the case of the dye receiving layer transfer head. Concretely, a line recording head having a resolution of 300 dpi is preferable. Further, the C-shaped edge-face head can be used.

In the image recording section, the dye of the dye transferer such as a sublimation type dye is thermally transferred onto the dye receiving layer on the intermediate record support from the dye layer by heating the dye transferer from its back surface using the image transfer head.

The stability of the thermal transfer recording is improved by recording the image onto the dye receiving layer transferred to the intermediate record support on the drum using the "edge-face head" as the image recording head, which is one of characteristics of the present invention.

It is noted that the cold-releasing mechanism is preferably also used in the image recording section. The "cold-releasing mechanism" in the image recording section means a mechanism in which both the dye transferer and the intermediate record support adhering to each other by heating by the image recording head are cooled while they are integral. In order to stably release the dye transferer which is adhering to the dye receiving layer on the intermediate record support from the dye receiving layer, it is important to cool them enough in the cold-releasing mechanism.

It is noted that the dye transferer comprises a substrate and a dye layer.

A substrate which is similar to the "substrate" for the dye receiving layer transferer as described above can be used as the "substrate" for the dye transferee.

The "dye layer" of the dye transferer means a layer which thermally transfers a dye such as a sublimation type dye to the dye receiving layer when it is heated and thereby an image is recorded. The dye layer preferably comprises the (sublimation type) dye and a binder resin.

A dye layer for Y, M or C can be formed by applying, using a printing method, an ink composition or a dye composition comprising the (sublimation type) dye for Y, M or C and the binder resin all over a substrate of the dye transferer for Y, M or C. It is noted that a dye transferer in which dye layers for Y, M and C, respectively, are repeatedly formed in series can be obtained by applying, using a printing method, compositions each comprising a (sublimation type) dye for Y and the binder resin, for M and the binder resin, and for C and the binder resin in series all over one substrate.

For example, a dye composition comprising at least two selected from a quinophtalone-based dye, a styryl-based dye and a pyridone azo-based dye is preferably used as the (sublimation type) dye for Y.

For example, a dye composition comprising at least two kinds of an imidazole azo-based dye which are different a little different in their end groups is preferable as the (sublimation type) dye for M. The dye composition may further comprise an antraquinone-based dye as required.

For example, a dye composition comprising a plurality of indoaniline-based dyes and an anthraquinone-based dye as a complementary color is preferable as the (sublimation type) dye for C.

As the "binder resin" which is contained in the dye layer, an acrylonitrile-styrene copolymer (AS) resin, a poly acetal resin, a polyester resin, a phenoxy resin, a single component-type epoxy resin and a mixture thereof can be mentioned. As to the AS resin, an AS resin which contains moieties (ca. 30 weight %) derived from acrylonitrile more than a conventional grade AS resin (ca. 23 weight %) is preferable since the former AS resin can improve an adhesive force between the substrate and the dye layer and heat resistive property of the dye layer, and further decrease in an adhesion between the dye layer and the dye transferee.

It is preferable that the dye transferer further comprises a heat-resistant sliding layer.

A heat-resistant sliding layer which is similar to the "heat-resistant sliding layer" for the dye receiving layer transferer as described above can be used as the "heat-resistant sliding layer" for the dye transferer.

A commercially available ink sheet for the usual thermal transfer printer of the sublimation dye transfer type can be used as the dye transferee.

The image transfer section comprises the image transfer head, a smaller diameter drum which faces the image transfer head via the intermediate record support and a smaller diameter drum which functions as a cold-releasing mechanism, and a (final) image receiver is preferably supplied from a rewinding section for the image receiver.

The image transfer head faces and is placed inside the intermediate record support which forms the closed loop. Therefore, the image recording head is provided at the opposite side of the intermediate record support to the dye receiving layer transfer head and the image recording head.

An edge-face head is used as the image transfer head, which is similar to the dye receiving layer transfer head as described above. For example, a commercially available C-shaped edge-face head (corner head) can be used as the image transfer head. Moreover, a commercially available edge-face head (resolution 300 dpi) for image recording can be used. Concretely, a line recording head having a resolution of 300 dpi may be used.

In the "image transfer section", the dye receiving layer on which the image has been recorded is heated from the back surface of the intermediate record support by the image transfer head, so that it is re-transferred to the (final) image receiver, and so that the intended image can be obtained.

The "edge-face head" is used as the image transfer head which is provided inside the intermediate record support which forms the closed loop, so that it is easy to control heating when the dye receiving layer on which the image has been recorded is re-transferred to the (final) image receiver. Therefore, it is easy to control re-transferring, which is one of the characteristics of the present invention.

In the present specification, the "(final) image receiver" can be variously selected depending on a condition to store the image receiver and an object to use the image, etc. Paper and a plastic cards etc. are generally preferable as the image receiver. Plain paper and coated paper for printing can be used as the paper.

Furthermore, the smaller diameter drum which functions as the cold-releasing mechanism is provided downstream the image transfer head. The distance between the smaller diameter drum and the image transfer head is preferably such a distance that the image receiving layer and the image receiver which have been heated are sufficiently cooled. Further, the smaller diameter drum is preferably used to accessorily drive the above recording temporary support.

A smaller diameter drum functions as a nip roller in order to release successfully from the intermediate record support the dye receiving layer. on which the image has been recorded. The image receiver is pressed to the image receiving layer on the intermediate record support by the smaller diameter drum which functions as the nip roller, so that the dye receiving layer can be re-transferred more stably onto the image receiver. The smaller diameter drum is preferably provided at a position such that it contacts with the smaller diameter drum which functions as the cold-releasing mechanism via both the intermediate record support and the image receiver.

The thermal transfer recording apparatus according to the present invention preferably comprises a cleaning mechanism for the intermediate record support.

There is no particular limitation on the cleaning mechanism so long as it is a mechanism which can clean the intermediate record support and eliminate a foreign material such as a dust, a stain which naturally adheres to the intermediate record support, and oil which exudes from various elements (for example, an element which is located at. the back of the image receiving layer transferee). The cleaning mechanism can be used to clean the front surface, the back surface, or both the front surface and the back surface of the intermediate record support.

When the front surface of the intermediate record support is cleaned, the cleaning mechanism is placed on the front surface of the intermediate record support at any position in a region downstream of the image transfer section and upstream of the dye receiving layer transfer section.

When the back surface of the intermediate record support is cleaned, the cleaning mechanism can be placed at any position on the back surface of the intermediate record support. The cleaning mechanism is preferably placed at a position which is downstream of the image transfer section and upstream of the dye receiving layer transfer section.

The thermal transfer recording apparatus of the present invention preferably comprises the cleaning mechanism which cleans the front surface of the intermediate record support and more preferably the cleaning mechanism which cleans both the front surface and the back surface of the intermediate record support.

Examples of the "cleaning mechanism" include a roller-using (roller-form) and a sheet-using (sheet-form) cleaning mechanisms.

As the roller-using cleaning mechanism, for examples a cleaning mechanism comprising a roller which contacts with the intermediate record support can be mentioned wherein the roller rotates dependently on the running of the intermediate record support so that it rotates at the same speed as the intermediate record support running and thereby the roller removes the stain through adhesion, or wherein the roller rotates at a speed lower than the intermediate record support is running so that the roller removes the stain through friction. It is noted that the roller preferably contacts with a smaller diameter drum via the intermediate record support wherein the smaller diameter drum substantially line-contacts with the intermediate record support or wherein a part of the outer periphery of the smaller diameter drum face-contacts with a part of the closed loop.

As the sheet-using cleaning mechanism, for example, a cleaning mechanism which comprises a roller contacting with the intermediate record support via a cleaning sheet as described below, the cleaning sheet (which is sandwiched between the roller and the intermediate record support), a rewinding section and a winding section for the cleaning sheet can be exemplified, wherein the cleaning sheet moves dependently on running of the intermediate record support so that it moves at the same speed as the intermediate record support running and thereby the cleaning sheet removes the stain through adhesion, or wherein the cleaning sheet moves at a speed lower than the intermediate record support is running, so that the cleaning sheet removes the stain through friction. It is noted that such a roller preferably contacts with a smaller diameter drum via the intermediate record support and the cleaning sheet wherein the smaller diameter drum substantially line-contacts with the intermediate record support or wherein a part of the outer periphery of the smaller diameter drum face-contacts with a part of the closed loop.

In any of the roll-using cleaning mechanism and the sheet-using cleaning mechanism, the running speed in the cleaning mechanism is preferably so low as 1/n (n is a positive integer and includes infinity (i.e., the cleaning mechanism is stopped)) of the running speed of the intermediate record support, since a large cleaning effect can be obtained.

As a roll-form or sheet-form material which is used in the cleaning mechanism, i.e., a "cleaning material", for example, a nonwoven fabric comprising a plastic or pulp material is preferable.

As the "pulp material", general commercial cooking paper and so on can be used. Neorânu (Japanese pronunciation) (trade name) manufactured by Kureha Chemical Industry Co., Ltd. and Rîdo (Japanese pronunciation) (trade name) manufactured by Oji Paper Co., Ltd. are exemplified.

As the "plastic material", a polypropylene (PP) resin, a polyester resin (e.g. PET), an acrylic resin, an aramid resin and mixtures thereof are exemplified.

The "nonwoven fabric" preferably has a thickness in the range of 10–200 $\mu$m. As the "nonwoven fabric", PP/PET based nonwoven fabric such as B and BT types (trade name) manufactured by Unisel Co., Ltd. and an aramid based/polyester based nonwoven fabric such as CONEX MX series (trade name) manufactured by Teijin can be used.

There is no particular limitation on a mixing ratio (weight ratio) of the aramid fiber/the polyester fiber in the aramid based/polyester based nonwoven fabric so long as the nonwoven fabric functions as the cleaning material. The mixing ratio (weight ratio) may be in the range of 40/60–30/70. The aramid based/polyester based nonwoven fabric preferably has a thickness in the range of 50–100 $\mu$m.

As the roll-form material used in the cleaning mechanism, a silicone rubber is preferable.

A porosity of the silicone rubber is preferably in the range from 10% to 50%.

Examples of such silicone rubber include Rôren (Japanese pronunciation) S (trade name) manufactured by Toyo Polymer Co., Ltd.

A hardness of the silicone rubber is preferably not more than 20.

The "hardness of the silicone rubber" means a value which is determined according to the method described in JIS K6301 (Physical Test Methods for Vulcanized Rubber).

The silicone rubber preferably contains no or a small amount of a low molecular weight oil component.

The thermal transfer recording apparatus of the present invention preferably comprises a meandering (or traversing) preventive mechanism for the intermediate record support in order to prevent the intermediate record support from meandering (waving or traversing).

When the sprocket manner is not used in the driving mechanism for the intermediate record support, the thermal transfer recording apparatus more preferably comprises the meandering preventive mechanism.

There is no particular limitation on a position at which the meandering preventive mechanism is located, but the position is preferably in the region downstream of the image transfer section and upstream of the dye receiving layer transfer section. Moreover, when the dye receiving layer transfer section is faced to and placed on the outside of the intermediate record support on an outer periphery of a drum and the image recording section is faced to and placed on the outside of the intermediate record support on an outer periphery of another drum, the meandering preventive mechanism may be located in a region downstream of the dye receiving layer transfer section and upstream of the image recording section. There is also no particularly limitation on the number of meandering preventive mechanisms.

There is no particular limitation on the meandering preventive mechanism for the intermediate record support so long as it can function as the meandering preventive mechanism for the intermediate record support. Examples thereof include a meandering preventive mechanism comprising an L-shaped guide or a slope forming guide which faces to each edge portion of the intermediate record support.

Further, the thermal transfer recording apparatus of the present invention can comprise an additional mechanism if necessary. For example, it may comprise a smaller diameter drum which functions as a tension adjusting roller (or tension roller) in order to adequately retain the tension which acts on the intermediate record support. The tension adjusting roller is preferably placed in the region downstream of the image transfer section and upstream of the dye receiving layer transfer section. Further, the tension adjusting roller is preferably placed downstream of the auxiliary drive roller or the nip roller which is preferably positioned in the image transfer section. The tension adjusting roller preferably provides a tension with the intermediate record support from the outside of the intermediate record support. A part of the outer periphery of the tension adjusting roller more preferably contacts with a part of the closed loop.

It is noted that a dye transferer in which the dye layers for Y, M and C are formed in series can be used for the image recording section comprising a single image recording head. In this case, the thermal transfer recording apparatus can be more compact.

The present invention further provides a novel thermal transfer recording method. The thermal transfer recording apparatus of the present invention described above can be appropriately used in such thermal transfer recording method.

The thermal transfer recording method of the present invention comprises the following three steps:

a dye receiving layer transfer step in which a supplied dye receiving layer transferer is heated from its back surface by a dye receiving layer transfer head, so that a given dye receiving layer is transferred to an intermediate record support in a "dye receiving layer transfer section";

an image recording step in which a supplied dye transferer is heated from its back surface by an image recording head, so that a dye thermally transfers to the dye receiving layer on the intermediate record support and thereby an image is thermal transfer recorded in an "image recording section"; and an image transfer step in which the intermediate record support is heated from its back surface by an image transfer head, so that the dye receiving layer on which the image has been recorded is re-transferred to a supplied (final) image receiver in an "image transfer section".

In the dye receiving layer transfer section, a dye receiving layer having a given size which is a little larger than the size of the image is cut off from the dye receiving layer tranferer according to an image signal and transferred onto the intermediate record support. Since only a part of the dye receiving layer to be cut off is heated by the dye receiving layer transfer head, the dye receiving layer having the given size adheres to the intermediate record support. The dye receiving layer is cooled while in such an adhering state and thereby, it temporarily bonds to the intermediate record support (until the dye receiving layer is released again in the image recording section). Therefore, the dye receiving layer having the given size is finally left on the intermediate record support by cold-releasing, preferably at an angle which is greater than a certain angle, that is, the dye receiving layer is cut off.

In the dye receiving layer transfer section, the dye receiving layer transferer is fed between the dye receiving layer transfer head and a drum over which the dye receiving layer transferer is positioned along the drum from the upstream of the dye receiving layer transfer head. After the only given part of the fed dye receiving layer transferee is heated from its back surface by the dye receiving layer transfer head, such part is released from the dye receiving layer transferee. Before releasing the dye receiving layer transferee, it may be cooled with a fans etc. Moreover, a cold-releasing mechanism is preferably used in order to release the dye receiving layer transferee. When the cold-releasing mechanism is used, the dye receiving layer transferer is released from the intermediate record support at a steep angle of not less than 45 degrees in the cold-releasing mechanism. Cutting off of the dye receiving layer can be carried out by pre-heating it, adding an excessive thermal energy steeply at the point where the cutting is started, and conditioning its thermal history afterward. Furthermore, in order to transfer the dye receiving layer more stably, the above angle (cold-releasing angle) at which the dye receiving layer transferer is released from the intermediate record support is preferably not less than 60 degrees and more preferably not less than 90 degrees as described above.

When a leading edge of the dye receiving layer which has been cut off and transferred as described above arrives at the image recording section, image recording is started. Three images of Y, M and C are recorded on the same single image receiving layer in sequence.

A method which is conventionally used in the thermal transfer recording method is employed as an image recording method in the image recording section. It is noted that the transferred dye receiving layer as described above temporarily bonds to the intermediate record support and is not completely fixed with an adhesive, etc., so that it is necessary to enough cool the dye transferer which is attached to the dye receiving layer on the intermediate record support when the dye transferer is released from the dye receiving layer. Therefore, the cold-releasing mechanism is preferably also used in the image recording section, and the releasing step therein is important.

It is noted that when the image recording section comprises the image recording sections for Y, M and C, each of images of Y, M and C is recorded on the same one dye receiving layer in sequence in each of the corresponding image recording sections for Y, M and C.

Finally, in the image transfer section, the dye receiving layer on which the image has been recorded as above described is transferred wholly onto an arbitrary (final) image receiver such as plain paper (i.e., the whole of the image receiving layer on which the image has been recorded is re-transferred on the image receiver by heating), so that the objective image can be obtained.

A cold-releasing step is also particularly important in the image transfer section after the image has been re-transferred. The re-transfer of the image is carried out when the image transfer head is preferably separated enough from the smaller diameter drum which functions as the cold-releasing mechanism. It is particularly preferable that the distance is such that the image receiver can be released from the intermediate record support after the whole of the dye receiving layer on the intermediate record support has been re-transferred to the image receiver.

The intermediate record support circulates to the dye receiving layer transfer section again and then the above described steps are repeated.

The intermediate record support is preferably cleaned by the cleaning mechanism before the dye receiving layer is thermally transferred again.

In order to prevent the intermediate record support from meandering (or traversing), the meandering (or traversing) preventive mechanism is preferably used to carry out the thermal transfer recording stably.

The above described steps are carried out continuously in sequence, so that the dye receiving layer transfer head, the image recording head(s) and the image transfer head operate simultaneously in the steady state. Therefore, for example, when an image is being recorded, the dye receiving layer transfer step is operating simultaneously so as to receive the next image.

When the image is recorded continuously using the thermal transfer recording apparatus of the present invention, the dye receiving layers which have been cut and transferred are positioned in series at a substantially constant spacing on the intermediate record support in a region between the downstream of the dye receiving layer transfer section and the upstream of the image transfer section. This makes high speed and continuous printing possible. For example, when recording of an A6 size image which is positioned transversely (or transverse A6 size recording) is carried out at a rate of 5 ms/line using line recording heads each having a resolution of 300 dpi as the dye receiving layer transfer head and the image transfer head, it takes 30–40 seconds to obtain the first print. However, when the thermal transfer recording is carried out continuously, one print can be obtained within ten seconds, so that 24 prints can be obtained within four minutes.

EMBODIMENTS OF THE INVENTION

The thermal transfer recording apparatus according to the present invention and the thermal transfer recording method using the thermal transfer recording apparatus will be explained hereinafter with reference to the accompanying drawings.

Embodiment 1 of the Thermal Transfer Recording Apparatus

FIG. 1 shows an example of a constitution of one embodiment of the thermal transfer recording apparatus according to the present invention.

An intermediate record support 610 which forms a closed loop is placed such that the loop extends over a larger diameter drum 600 and smaller diameter drums (or rollers) 620, 630 and 540 and contacts with a roller 560 via an image receiver 510. The larger diameter drum 600 has a diameter of for example, about 200 mm, and the smaller diameter drum has a diameter of, for example, about 50 mm or less. A dye receiving layer transfer section 100 and image recording sections for three primary colors (for Y, M and C) 200, 300 and 400 are placed on an outside of the intermediate record support 610 on a part (about two thirds in the embodiment shown in FIG. 1) of the outer periphery of the larger diameter drum 600. An image transfer section 500 is placed adjacent to and downstream of the image recording section 400.

The dye receiving layer transfer section 100 comprises a dye receiving layer transferer 111 a rewinding section 120 and a winding section 150 for the dye receiving layer transferee, a dye receiving layer transfer head 130, and a cold-releasing mechanism 140 for the dye receiving layer transferee. The receiving layer transfer head 130 is positioned so as to face to the intermediate record support 610. The dye receiving layer transferer 110 is fed from the rewinding section 120 to a space between the dye receiving layer transfer head 130 and the intermediate record support 610, and pressed and heated by the dye receiving layer transfer head 130 while retained with the intermediate record support 610 together. When the dye receiving layer transferer passes the cold-releasing mechanism 140, the dye receiving layer transferer is wound by the winding section 150, so that a given dye receiving layer alone is left on the intermediate record support and is sent to the image recording section by the intermediate record support 610.

The image recording section 200 for Y comprises a dye transferer 210 for Y, a rewinding section 220 and a winding section 250 for the dye transferer for Y, an image recording head 230 for Y, and a cold-releasing mechanism 240 for the dye transferer for Y. The dye transferer 210 for Y is fed to a space between the image recording head 230 and the intermediate record support 610 from the rewinding section 220, and pressed and heated by the image recording head 230, so that the dye transferer 210 is retained together with the intermediate record support 610 after the dye for Y is transferred to the dye receiving layer. When the dye transferer for Y passes through the cold-releasing mechanism 240, it is wound by the winding section 250, so that the dye receiving layer alone is left on the intermediate record support and is moved to the image recording section for M by the intermediate record support 610.

The image recording section 300 for M comprises a dye transferer 310 for M, a rewinding section 320 and a winding section 350 for the dye transferer for M, an image recording head 330 for M, and a cold-releasing mechanism 340 for the dye transferer for M. The dye transferer 310 for M is fed to a space between the image recording head 330 and the intermediate record support 610 from the rewinding section 320, and pressed and heated by the image recording head 330, so that the dye transferee 310 is retained with the intermediate record support 610 together after the dye for M is transferred to the dye receiving layer. When the dye transferer for M passes through the cold-releasing mechanism 340, it is wound by the winding section 350, so that the dye receiving layer alone is left on the intermediate record support and is moved to the image recording section for C by the intermediate record support 610.

The image recording section 400 for C comprises a dye transferer 410 for C, a rewinding section 420 and a winding section 450 for the dye transferer for C, an image recording head 430 for C, and a cold-releasing mechanism for the dye transferee 440 for C. The dye transferer 410 for C is fed to a space between the image recording head 430 and the intermediate record support 610 from the rewinding section 420, and pressed and heated by the image recording head 430, so that the dye transferer 410 is retained with the intermediate record support 610 together after the dye for C is transferred on the dye receiving layer. When the dye transferer for C passes through the cold-releasing mechanism 440, it is wound by the winding section 450, so that the dye receiving layer alone is left on the intermediate record support and is moved to the image transfer section by the intermediate record support 610.

The image recording sections for Y, M and C 200, 300 and 400 are placed around the larger diameter drum 600 in tandem separately by a spacing equal to or larger than a corresponding dimension of a desired image. For example, when the desired image is of an A6 size which is positioned transversely, the image recording sections for Y, M and C are spaced by a spacing of about 110 mm.

Each of the image recording heads for Y, M and C 230, 330 and 430 is provided so as to face to the intermediate record support 610 on the outer periphery of the intermediate record support 610. The image recording heads for Y, M and C 230, 330 and 430 are placed preferably separately by an equal spacing.

The image transfer section 500 comprises a (final) image receiver 510, a rewinding section 520 for the image receiver, an image transfer head 530, a smaller diameter drum 560, and a smaller diameter drum 540 which functions as a cold-releasing mechanism (which functions also as a guide roller).

It is noted that the image transfer head 530 is provided inside the intermediate record support 610 so as to face to the intermediate record support 610.

Figure 2:
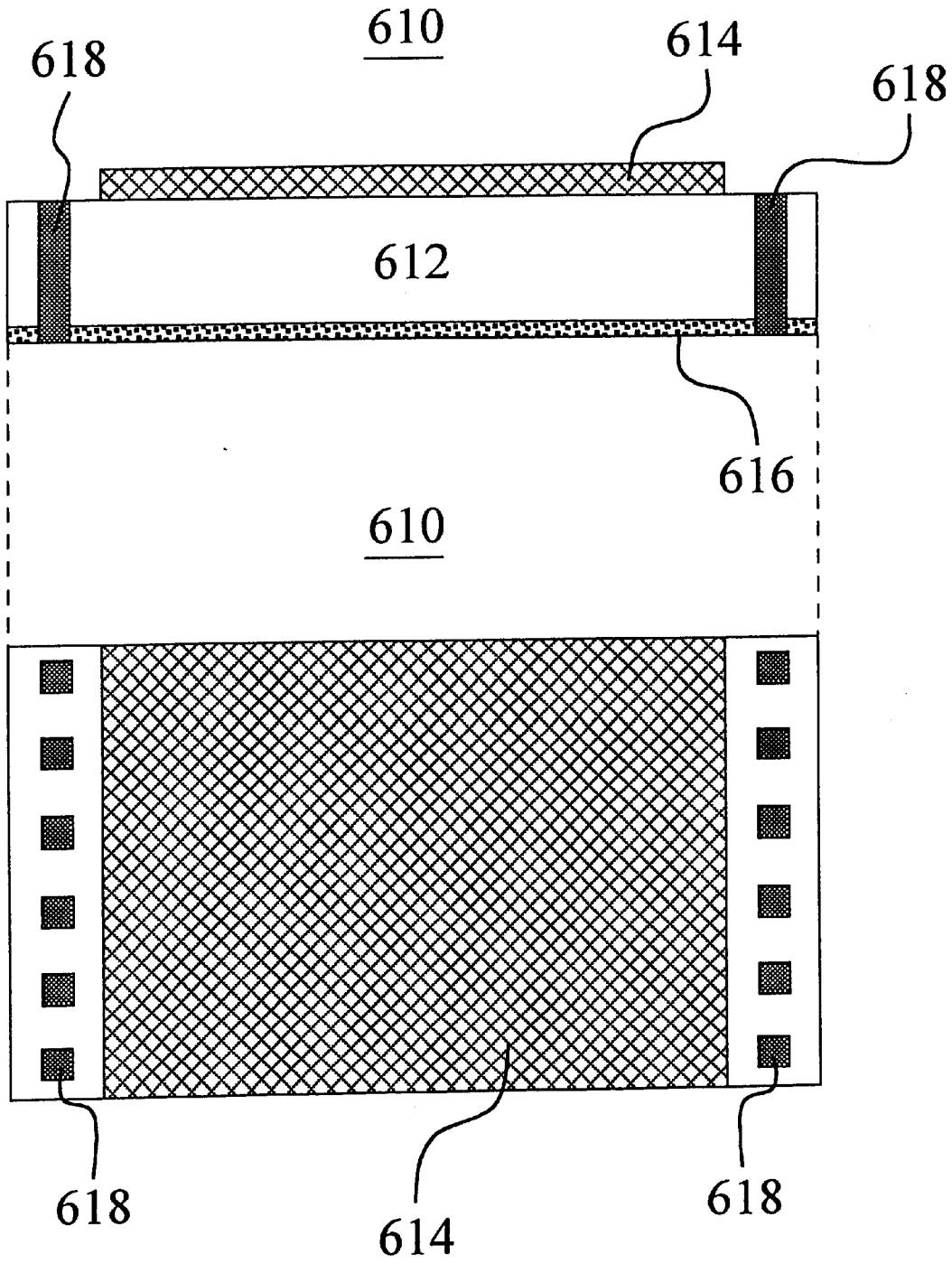
FIG. 2 shows a top view and a cross-sectional view across a direction of an axis of an example of an intermediate record support.

FIG. 2 shows a cross-sectional view and a top view of one example of the intermediate record support 610. The intermediate record support 610 comprises a functional layer 614 on a front surface of a belt-form closed loop substrate 612 and a heat-resistant sliding layer 616 on a back surface of a substrate 612. It is noted that the functional layer and/or the heat-resistant sliding layer may be omitted. In the shown embodiment, in order to prevent the intermediate record support 610 from meandering and traversing (sliding), sprocket holes 618 are provided in both the edge portions 618 of the intermediate record support.

Figure 3:
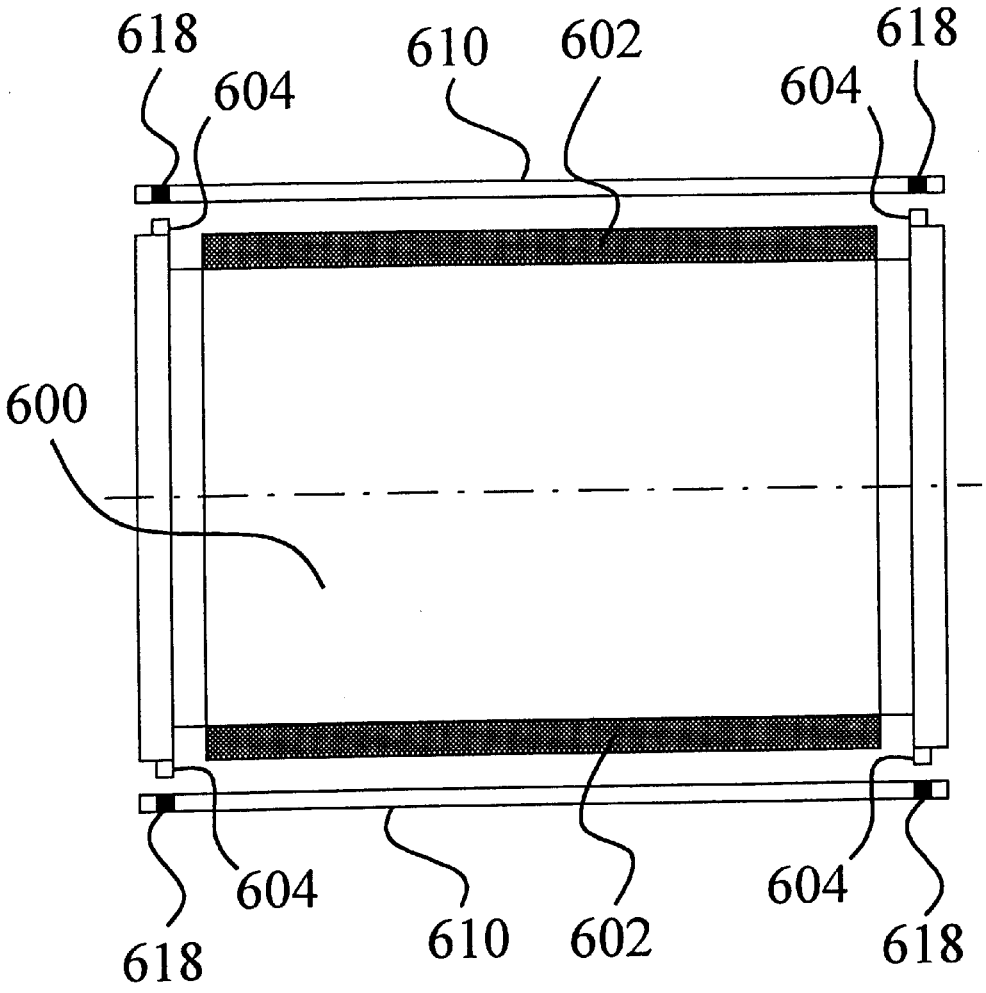
FIG. 3 shows a cross-sectional view along an axis direction of an example of a larger diameter drum.

FIG. 3 shows a cross-sectional view along an axis direction of one example of the larger diameter drum 600. The intermediate record support 610 which contacts with and around the outer periphery of the larger diameter drum 600 is shown and separated from the larger diameter drum a little. An elastic member 602 of, for example, a rubber having a hardness in the range of 60–70 degrees is provided around the surface of the larger diameter drum 600 except for both end portions. Protruding portions 604 which engage with sprocket holes 618 of the intermediate record support 610 are formed in the periphery directions on both end portions of the surface of the larger diameter drum 600.

The intermediate record support 610 which forms the belt-form closed loop of the thermal transfer recording apparatus as shown in FIG. 1 is driven by a driving apparatus which drives and links with a main shaft of the larger diameter drum 600. A main driving force for the intermediate record support 610 is a friction force between the elastic member 602 on the surface of the larger diameter drum 600 and the back surface of the intermediate record support 610. Driving the intermediate record support 610 with the larger diameter drum 600 is the main drive.

Driving the intermediate record support accesorily (auxiliary drive) is carried out by using a driving apparatus, for example, a smaller diameter drum 540. The intermediate record support 610 is driven by the combination of the main drive and the auxiliary drive. The roller which is used for the auxiliary drive is referred to as a roller for the auxiliary drive.

When a peripheral speed (or a speed of the outer periphery) of the smaller diameter drum 540 for the auxiliary drive is faster than that of the larger diameter drum 600 for the main drive, the intermediate record support 610 can be driven stably even if a large tension is supplied to the intermediate record support 610.

When a tension roller which can apply a tension to the intermediate record support from its outside is positioned downstream of the roller for the auxiliary drive or the nip roller, the intermediate record support can be moved stably even when the plurality of the heads (for example, a total of five heads including one dye receiving layer transfer head, three image recording heads and one image transfer head) are operated simultaneously.

Therefore, for driving the intermediate record support 610 of the thermal transfer recording apparatus shown in FIG. 1, it is not always necessary to provide the sprocket holes 618 with the intermediate record support 610 and to provide the protruding portions (sprockets) 604 with the larger diameter drum 600.

When the sprocket holes are not used, the intermediate record support 610 without the sprocket holes 618 as in FIG. 2 and the larger diameter drum 600 without the protruding portions 604 in FIG. 3 can be used. Therefore, the width of the intermediate record support 610 can be narrowed by a corresponding width for the sprocket holes 618 of the intermediate record support 610, and the width of the larger diameter drum 600 can be narrowed by a corresponding width for the protruding portions 604 of the larger diameter drum 600.

In the thermal transfer recording apparatus in FIG. 1, for driving the intermediate record support 610, a method of the so-called sprocket manner can be additionally used in which the sprocket holes 618 are provided with the intermediate record support 610.

Driving the intermediate record support 610 is also carried out with both the main drive and the auxiliary drive as described above in the sprocket manner. However, sliding of the intermediate record support 610 is surely prevented by the protruding portions 604 of the larger diameter drum which engage with the sprocket holes 618 of the intermediate record support 610. The mechanism which comprises the sprocket holes 618 and the protruding portions 604 also can function simultaneously as a meandering preventive mechanism of the intermediate record support 610.

A thermally and mechanically highly stable film such as a polyimide film can be used as the substrate 612 of the intermediate record support 610 whether the sprocket manner is additionally used or not. In such case, the functional layer 614 and the heat-resistant sliding layer 616 of the intermediate record support 610 are not always necessary.

Figure 4:
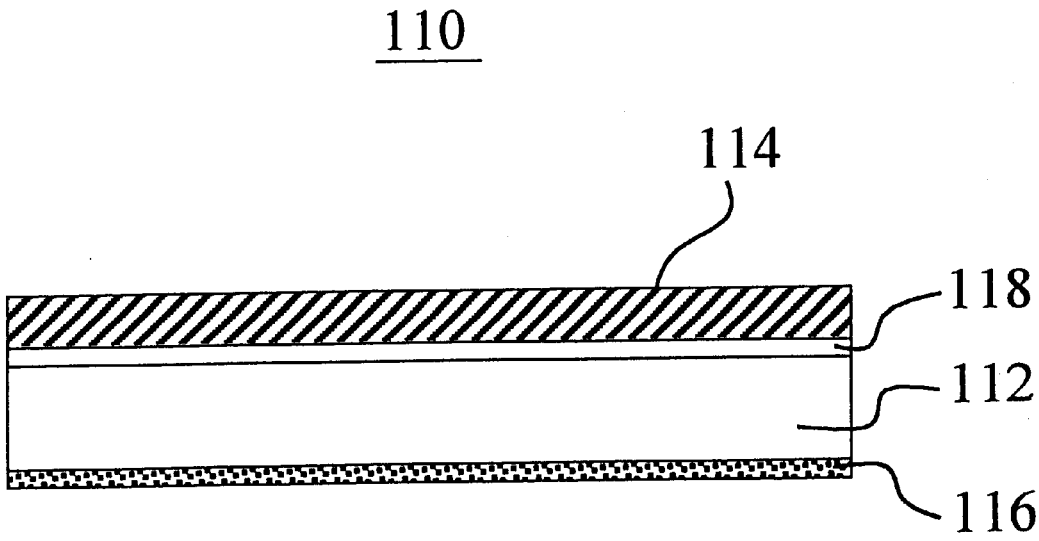
FIG. 4 shows a cross-sectional view of an example of a dye receiving layer transferee.

FIG. 4 shows a cross-sectional view of one example of the dye receiving layer transferer 110. A dye receiving layer 114 is formed on the front surface of a substrate 112 of the dye receiving layer transferer 110 and a heat-resistant sliding layer 116 is formed on the back surface of the substrate 112 of the dye receiving layer transferer 110. If necessary, a releasing layer 118 may be provided between the substrate 112 and the dye receiving layer 114. In this case, since separating the dye receiving layer 114 from the dye receiving layer transferer 110 is easy, it is easy to leave the dye receiving layer 114 on the intermediate record support.

Ink sheets which are employed in the conventional thermal transfer printer can be used as the dye transferees for Y, M and C 210, 310 and 410.

A commercially available edge-face head (resolution 300 dpi) for the thermal transfer recording can be used for the dye receiving layer transfer head 130 and the image transfer heads for Y, M and C 230, 330 and 430. A commercially available C-shaped edge-face head (corner head) can be used for the image transfer head 530.

Operation of the thermal transfer recording apparatus of the embodiment as shown in FIG. 1 is explained.

In the dye receiving layer transfer section 100, the dye receiving layer 114 having any defined (or desired) size which is a little larger than that of the image to be recorded is cut off based on an image signal and transferred onto the intermediate record support 610.

In the dye receiving layer transfer section 100, the dye receiving layer transferer 110 is laid over the intermediate record support 610 on the outer periphery of the larger diameter drum 600 upstream of the dye receiving layer transfer head 130, and then positioned between the dye receiving layer transfer head 130 and the intermediate record support 610. After a given shaped part of the dye receiving layer transferer 110 which is positioned between the dye receiving layer transfer head 130 and the intermediate record support 610 is heated from its back surface by the dye receiving layer transfer head 130, the dye receiving layer transferer 110 is cooled together with the intermediate record support 610 by using, for example, a fan (not shown), and is released from the intermediate record support 610 at a steep angle of 45 degrees or more in the cold-releasing mechanism 140 for the dye receiving layer transferee.

It is noted that in the cold-releasing mechanism 140, the angle (cold-releasing angle) at which the dye receiving layer transferer 110 is released from the intermediate record support is shown as the angle ($\alpha$) which is formed by a plane in tangent contact with the outer periphery of the larger diameter drum 600 and a plane along which the dye receiving layer transferer 110 is wound by the winding section 150 for the dye receiving layer transferer with respect to a line which is formed by intersection of the intermediate record support 610 with the plane along which the dye receiving layer transferer 110 is wound by the winding section 150 for the dye receiving layer transferer, when the intermediate record support 610 on the, outer periphery of the larger diameter drum 600 is released from the dye receiving layer transferer 110 in the cold-releasing mechanism 140.

When a leading edge of the dye receiving layer which has been thus cut off and transferred arrives at the image recording section 200 for Y, recording an image for Y is started. Similarly, images for M and C are formed on the same dye receiving layer in the image recording sections 300 and 400 in sequence.

A conventional method is used as the image recording method for Y, M and C in the image recording sections for Y, M and C 200, 300 and 400. It is noted that the dye receiving layer which has been thus cut off and transferred is attaching temporarily onto the intermediate record support 610 and is not fixed on it. Therefore, the dye transferees for Y, M and C 210, 310 and 410 are released from the dye receiving layer. The dye transferers must be cooled enough together with the dye receiving layer. Therefore, the release in the cold-releasing mechanisms 240, 340 and 440 for the dye transferers for Y, M and C is important. It is preferable that enough cooling and a preferable releasing angle are ensured before the release.

Finally, in the image transfer section 500, the whole of the dye receiving layer on which the three color images have been recorded as described above is transferred onto an arbitrary (final) image receiver 510 such as plain paper, so that an objective image is obtained while it is placed on the image receiver 510.

In the image transfer section 500 also, cold-releasing is particularly important after the dye receiving layer (on which the image has been recorded) has been re-transferred. Therefore, enough cooling is ensured in order to separate the image transfer head 530 from the smaller diameter drum 540 which functions as a cold releasing mechanism by a sufficient spacing. The whole of the dye receiving layer on the intermediate record support 610 which layer is heated from the side of the intermediate record support 610 by the image transfer head 530 is cooled enough while the image receiving layer is attached to the image receiver 510, and then the image receiver 510 is released from the intermediate record support 610, so that the image receiving layer is substantially re-transferred onto the image receiver 510. Then, the image receiver 510 which has received the dye receiving layer thereon may be subjected to an adequate after-treatment such as being to a given size being wound.

In the image transfer section 500, the intermediate record support 610 which has finished the thermal transfer recording is guided by smaller diameter drums 620 and 625, and returns to the dye receiving layer transfer section 100, and the above described steps are repeated. It is noted that before a dye receiving layer 110 is transferred to the intermediate record support 610 again, in order to clean the surface of the functional layer 614 of the intermediate record support 610, it is preferable that a function such as the cleaning roller is provided with the smaller diameter drum 625, so that the surface of the intermediate record support 610, for example, the functional layer 614 is cleaned.

The described steps are carried out continuously in sequence, so that the five heads, i.e., the dye receiving layer transfer head 130, the image recording heads 230, 330 and 430, and the image transfer head 530 work simultaneously. Therefore, for example, when the image for Y is being recorded, the dye receiving layer transfer step is working simultaneously in order to prepare the next image.

When continuous image recording is carried out using the thermal transfer recording apparatus of the embodiment shown in FIG. 1, the dye receiving layers which have been cut off and transferred are arranged, while spaced by an equal interval, on almost the whole of the region of the intermediate record support 610 from the dye receiving layer transfer section 100 to the image transfer section 500. By this arrangement, a high speed continuous printing can be performed. When transverse A6 size recording is carried out at a rate of 5 ms/line by using the line recording-heads having resolution of 300 dpi as the dye receiving layer transfer head 130 and the image recording heads for Y, M and C 230, 330 and 430, it takes 30–40 seconds for the first print. However, when the continuous printing is performed under the same conditions, one print can be obtained within ten seconds and twenty four prints can be obtained within four minutes.

Embodiment 2 of the Thermal Transfer Recording Apparatus

Figure 5:
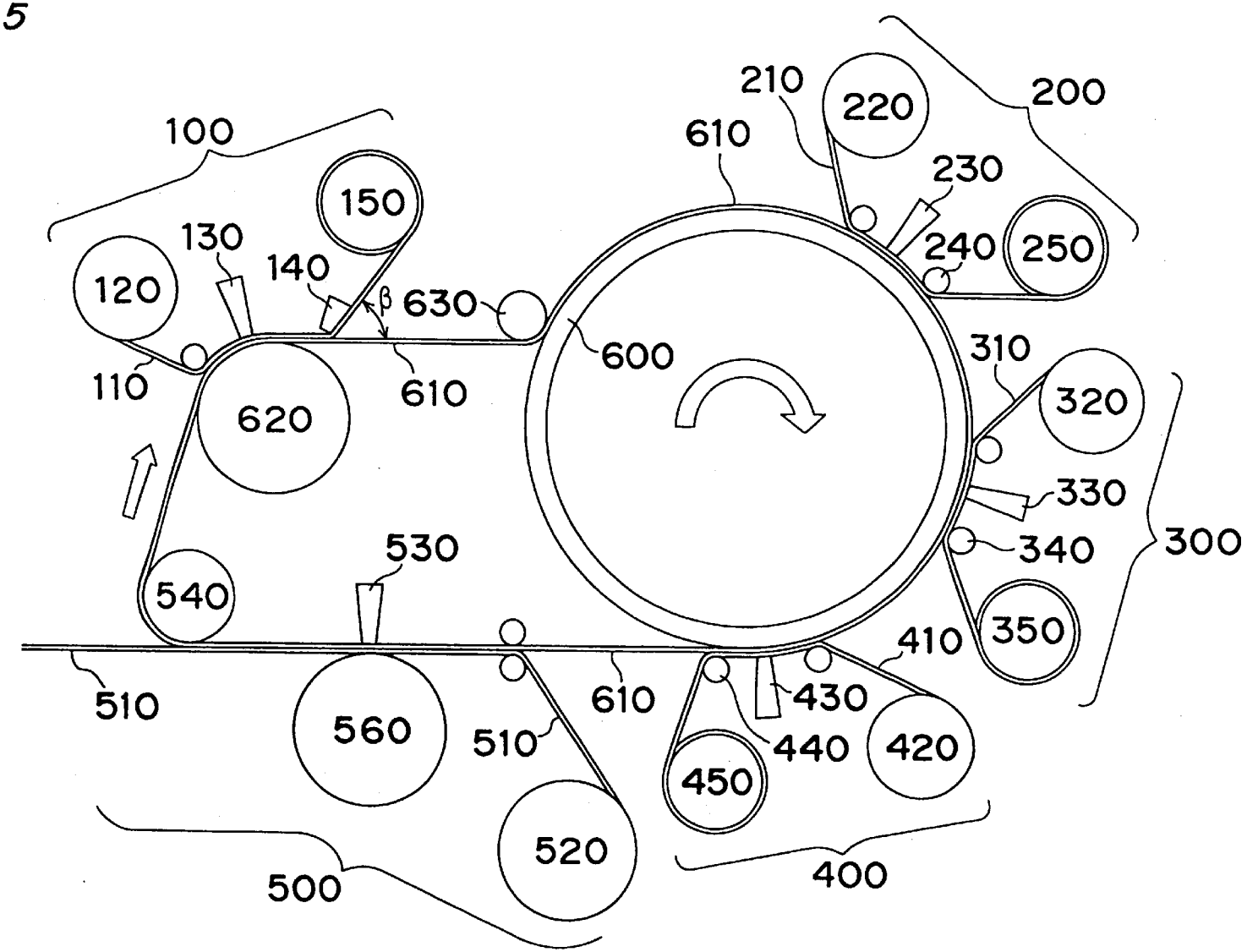
FIG. 5 shows another embodiment of the thermal transfer recording apparatus according to the present invention.

FIG. 5 shows an example of a constitution of another embodiment of the thermal transfer recording apparatus of the present invention.

The thermal transfer recording apparatus shown in FIG. 5 has a constitution substantially the same as that of the apparatus shown in FIG. 1 except that the smaller diameter drum 625 is removed and the dye receiving layer transfer section 100 is placed outside of the intermediate record support 610 which is on the outer periphery of the smaller diameter drum 620 as compared to in the thermal transfer recording apparatus shown in FIG. 1.

As to the intermediate record support 610, the larger diameter drum 600, the driving method for the intermediate record support 610, the dye receiving layer transfer 110, the dye transferers for Y, M and C 210, 310 and 410, the dye receiving layer transfer head 130, the image recording heads for Y, M and C 230, 330 and 430, and the image transfer head 530, etc. which are used in the thermal transfer recording apparatus in FIG. 5, they are the same as those in the thermal transfer recording apparatus in FIG. 1.

The dye receiving layer transfer section 100 is placed outside of the intermediate record support 610 on the outer periphery of the smaller diameter drum 620. Therefore, the operation of the thermal transfer recording apparatus of the embodiment shown in FIG. 5 is substantially the same as that of the apparatus shown in FIG. 1, except that the dye receiving layer transferer 110 is laid on the intermediate record support on the outer periphery of the smaller diameter drum 620 and is positioned between the dye receiving layer transfer head 130 and the intermediate record support 610.

In the thermal transfer recording apparatus shown in FIG. 5, the dye receiving layer transferer 110 is released from the intermediate record support 610 which does not lie on the outer periphery of the larger diameter drum 600 in the cold-releasing mechanism 140. Therefore, in such a cold-releasing mechanism 140, the angle at which the dye receiving layer transferer 110 is released from the intermediate record support (cold-releasing angle) is shown as an angle (β) formed by the intermediate record support and a plane along which the dye receiving layer transferer is wound by the winding section with respect to an intersection line of the intermediate record support with a plane along which the dye receiving layer transferer is wound by the winding section for the dye receiving layer transferee.

Continuous recording can be carried out using the thermal transfer recording apparatus shown in FIG. 5 as with using the thermal transfer recording apparatus shown in FIG. 1. When transverse A6 size recording is carried out at a rate of 5 ms/line by using the line recording heads having resolution of 300 dpi as the dye receiving layer transfer head 130 and the image recording heads for Y. M and C 230, 330 and 430 in the thermal transfer recording apparatus of the embodiment shown in FIG. 5, it takes 30–40 seconds for the first print. However, when the continuous printing is performed under the same conditions, one print can be obtained within ten seconds and twenty four prints can be obtained within four minutes.

Embodiment 3 of the Thermal Transfer Recording Apparatus

Figure 6:
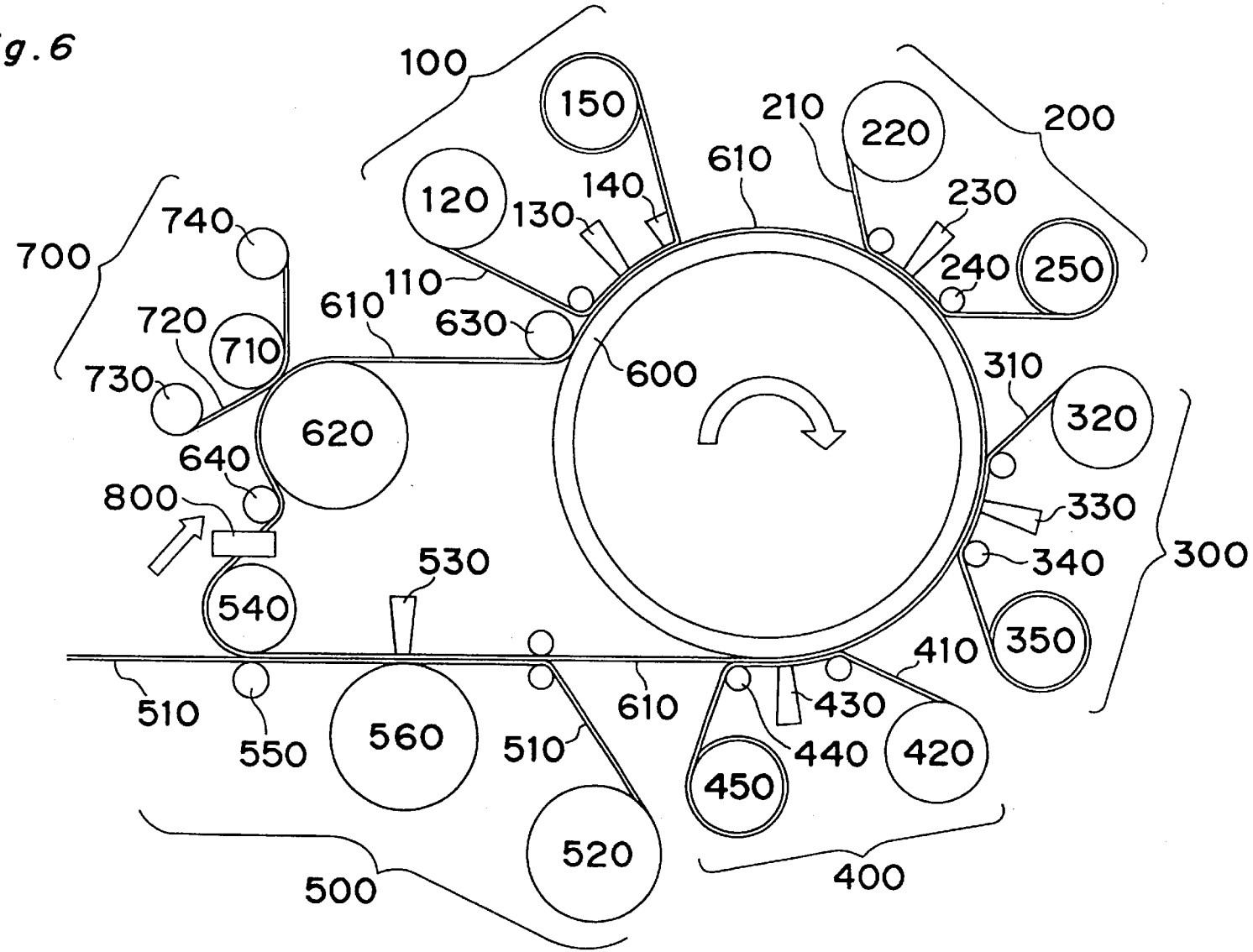
FIG. 6 shows a further embodiment of the thermal transfer recording apparatus according to the present invention.

FIG. 6 shows an example of a constitution of the other embodiment of the thermal transfer recording apparatus according to the present invention.

The thermal transfer recording apparatus shown in FIG. 6 has substantially the same constitution as that of the apparatus shown in FIG. 1 except that the smaller diameter drum 625 is removed, a cleaning mechanism 700 for the intermediate record support 610 is placed outside the intermediate record support 610 on the outer periphery of the smaller diameter drum 620, a smaller diameter drum 550 which contacts with the smaller diameter drum 540 is provided in the image transfer section 500, and a smaller diameter drum 640 and a meandering preventive mechanism 800 are placed upstream of the cleaning mechanism 700 and downstream of the image transfer section 500 as compared to the thermal transfer recording apparatus shown in FIG. 1.

It is noted that the smaller diameter drum 550 functions as a nip roller. The smaller diameter drum 640 functions as a roller for adjusting the tension of the intermediate record support 610.

As to the intermediate record support 610, the larger diameter drum 600, the driving method for the intermediate record support 610, the dye receiving layer transferer 110, the dye transferers for Y, M and C 210, 310 and 410, the dye receiving layer transfer head 130, the image recording heads for Y, M and C 230, 330 and 430, and the image transfer head 530 etc. which are used in the thermal transfer recording apparatus in FIG. 6, they are the same as those in the thermal transfer recording apparatus in FIG. 1.

Figure 7:
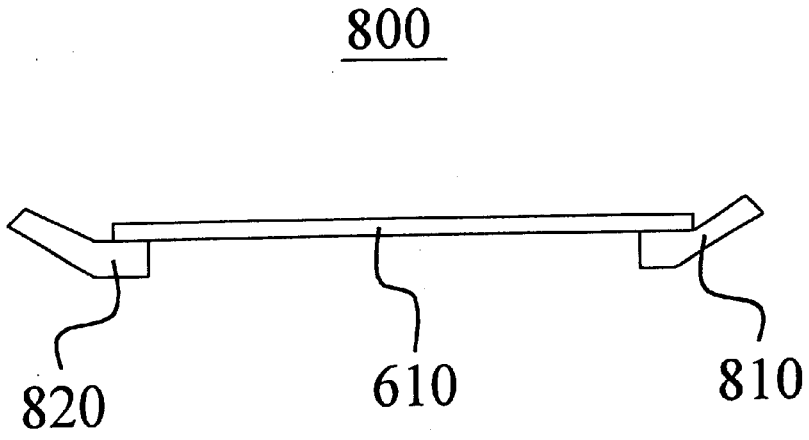
FIG. 7 shows an example of a meandering preventive mechanism for the intermediate record support.

The thermal transfer recording apparatus shown in FIG. 6 comprises the meandering preventive mechanism 800 for the intermediate record support 610. In FIG. 7 which schematically shows a cross section perpendicular to the running direction of the intermediate record support 610 (therefore, the intermediate record support 610 moves along a direction perpendicular to the paper surface of FIG. 7), one example of the meandering (or traversing) preventive mechanism 800 for the intermediate record support 610 is shown. The meandering preventive mechanism 800 comprises slope forming guides 810 and 820 which are placed along both of the edge portions of the intermediate record support 610. When the intermediate record support 610 moves transversely and becomes likely to run onto the slope, the intermediate record support 610 can be returned to the correct running position since the intermediate record support 610 is affected by a force which tends to make the support run down the slope of the guide by the slope forming guide. In the embodiment shown in the drawing, the guide forms the slope (i.e., the slope which is inclined relative to the intermediate record support along the moving direction of the intermediate record support 610). The slope may be inclined more steeply. Further, in another embodiment, the slope may be perpendicular to the intermediate record support, i.e., the meandering preventive mechanism may be of an L-shaped guide.

Such meandering preventive mechanism 800 is particularly effective when the above described sprocket manner is not additionally used in the driving method for the intermediate record support 610.

The thermal transfer recording apparatus shown in FIG. 6 further comprises the cleaning mechanism 700 for the intermediate record support 610. The cleaning mechanism 700 comprises the smaller diameter drum 620 (which also functions as a guide roller), a roller 710 which rotates dependently on the intermediate record support moving at the same speed as that of the intermediate record support or at lower speed than that of the intermediate record support, a cleaning sheet 720 and a rewinding section 730 and a winding section 740 for the cleaning sheet.

The operation of the thermal transfer recording apparatus shown in FIG. 6 is substantially the same as that of the thermal transfer recording apparatus shown in FIG. 1, except for the following:

In the image transfer section 500, the smaller diameter drum 550 which functions as a nip roller is provided in order to sharply release the dye receiving layer on which the image has been recorded from the intermediate record support 610. The intermediate record support 610 and the image receiver 510 are pressed to each other by the smaller diameter drum 550 while the dye receiving layer is supplied between them. Therefore, the dye receiving layer can be re-transferred more stably to the image receiver 510.

Since the thermal transfer recording apparatus shown in FIG. 6 comprises the cleaning mechanism 700, the intermediate record support 610 can be cleaned before a dye receiving layer 114 is transferred next in the dye receiving layer transfer section 100. Therefore, the thermal transfer recording can be carried out more stably. The cleaning sheet 720 may be used or the guide roller 710 itself may be used as a cleaning roller without using the cleaning sheet 720 in the cleaning mechanism 700. In any of roll-using and sheet-using cleaning mechanisms, the cleaning mechanism preferably operates at a running speed of 1/n (n is a positive integer and includes infinity (∞)) of the running speed of the intermediate record support 610, since an improved cleaning effect of the intermediate record support 610 can be obtained. Cleaning the intermediate record support 610 is important from viewpoints of eliminating a foreign material such as dust on the intermediate record support 610 and removing oil, etc. which exudes from various elements in various sections (for example, from a back side of the dye receiving layer transferer, a back side of the dye transferer and the like).

Continuous recording can be carried out using the thermal transfer recording apparatus shown in FIG. 6 as with the thermal transfer recording apparatus shown in FIG. 1. When transverse A6 size recording is carried out at a rate of 5 ms/line by using the line recording heads having resolution of 300 dpi as the dye receiving layer transfer head 130 and the image recording heads for Y, M and C 230, 330 and 430 in the thermal transfer recording apparatus of the embodiment shown in FIG. 6, it takes 30–40 seconds for the first print. However, when the continuous printing is performed under the same conditions, one print can be obtained within 7–10 seconds and twenty four prints can be obtained within four minutes.

It is noted that in the thermal transfer recording apparatus shown in FIG. 6, although the image recording sections for Y, M and C 200, 300 and 400 are provided outside of the intermediate record support 610 on the outer periphery of the larger diameter drum 600, the apparatus may have a constitution with only one of the image recording sections, i.e., only one image recording head is used and the dye transferee is used in which the dye layers for Y, M and C are formed in series. When such a construction is used, the thermal transfer recording apparatus can be made more compact.

Embodiment 4 of the Thermal Transfer Recording Apparatus

Figure 8:
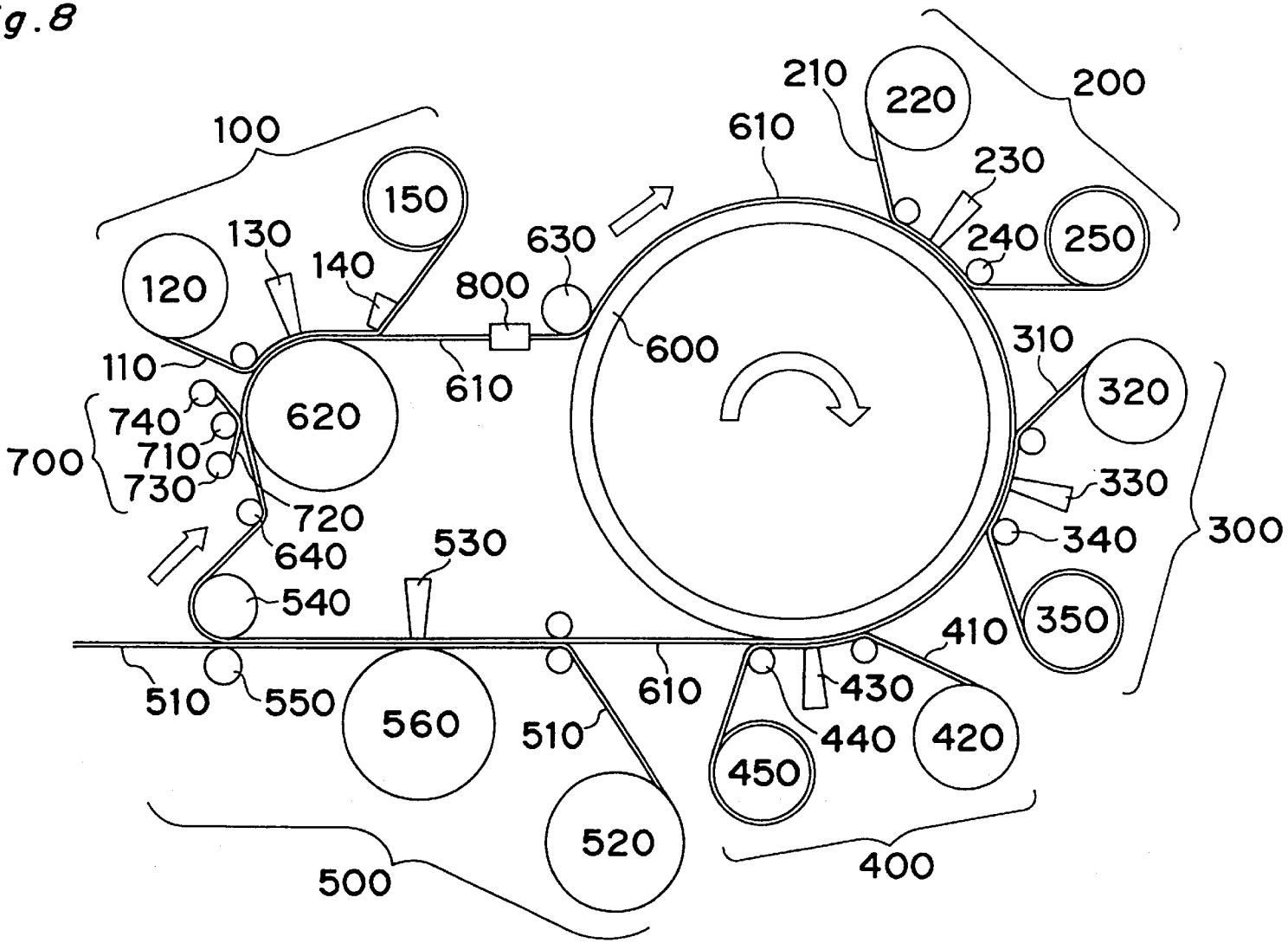
FIG. 8 shows a further embodiment of the thermal transfer recording apparatus according to the present invention.

FIG. 8 shows one example of one constitution of a further embodiment of the thermal transfer recording apparatus of the present invention.

The thermal transfer recording apparatus shown in FIG. 8 has substantially the same constitution as that of the apparatus shown in FIG. 6 except that the dye receiving layer transfer section 100 and the cleaning mechanism 700 are both placed outside of the intermediate record support 610 on the outer periphery of the smaller diameter drum 620, the meandering preventive mechanism 800 is placed downstream of the dye receiving layer transfer section 100 and upstream of the smaller diameter drum 630, and the larger diameter drum 600 has a diameter of for example about 150 mm and the smaller diameter drum has a diameter of for example about 70 mm or less as compared to the thermal transfer recording apparatus shown in FIG. 6.

As to the intermediate record support 610, the larger diameter drum 600, the driving method for the intermediate record support 610, the dye receiving layer transferer 110, the dye transferers for Y, M and C 210, 310 and 410, the dye receiving layer transfer head 130, the image recording heads for Y, M and C 230, 330 and 430, and the image transfer head 530, etc. which are used in the thermal transfer recording apparatus in FIG. 8, they are the same as those in the thermal transfer recording apparatus in FIG. 6.

The operation of the thermal transfer recording apparatus shown in FIG. 8 is substantially the same as that of the thermal transfer recording apparatus shown in FIG. 6 except that the dye receiving layer transferer 110 is laid on the intermediate record support on the outer periphery of the smaller diameter drum 620 and is supplied between the dye receiving layer transfer head 130 and the intermediate record support 610, since the dye receiving layer recording section 100 is placed outside the intermediate record support 610 on the outer periphery of the smaller diameter drum 620.

The angle at which the dye receiving layer transferer 110 is released from the intermediate record support (the cold-releasing angle) in the thermal transfer recording apparatus shown in FIG. 8 is shown as β in FIG. 5.

The operations of the image transfer section 500, the cleaning mechanism 700 and the meandering preventive mechanism 800 are substantially the same as those of the apparatus shown in FIG. 6.

Continuous recording can be carried out using the thermal transfer recording apparatus shown in FIG. 8 as in using the thermal transfer recording apparatus shown in FIG. 6. When transverse A6 size recording is carried out at a rate of 5 ms/line by using the line recording heads having resolution of 300 dpi as the dye receiving layer transfer head 130 and the image recording heads for Y, M and C 230, 330 and 430 in the thermal transfer recording apparatus of the embodiment shown in FIG. 8, it takes 30–40 seconds for the first print. However, when the continuous printing is performed under the same conditions, one print can be obtained within 7–10 seconds and twenty four prints can be obtained within four minutes.

It is noted that in the thermal transfer recording apparatus shown in FIG. 8, although the image recording sections for Y, M and C 200, 300 and 400 are provided outside of the intermediate record support 610 on the outer periphery of the larger diameter drum 600 as in the thermal transfer recording apparatus shown in FIG. 6, the apparatus may have a constitution with only one of the image recording sections, i.e. only one image recording head is used and the dye transferer is used in which the dye layers for Y, M and C are formed in series. When such construction is used, the thermal transfer recording apparatus can be made more compact.

Therefore, the constitution wherein only any one of the image recording sections, i.e., only one image recording head is used and the dye transferer is used in which the dye layers for Y, M and C are formed in series, can also be similarly employed in the thermal transfer recording apparatuses shown in FIGS. 1 and 5.

It is noted that the dye receiving layer and the dye layers are omitted for mere simplification in FIGS. 1, 5, 6 and 8.

EFFECT OF THE INVENTION

According to the present invention as described in detail, since the dye receiving layer transfer section and the image recording section(s) are placed outside of the intermediate record support on the outer periphery of the drum, the dye receiving layer is transferred more stably and the image is thermal transfer recorded to the dye receiving layer more stably. Further, since the image transfer head is positioned inside the intermediate record support so as to face to the intermediate record support which forms the closed loop, it becomes easy to control the re-transfer of the dye receiving layer on which the image has been recorded to the (final) image receiver.

When the dye receiving layer transfer section is placed outside of the intermediate record support on the outer periphery of the smaller diameter drum and the image recording section is placed outside of the intermediate record support on the outer periphery of the larger diameter drum, i.e., the constitution of the apparatus in which the both sections are placed separately is adopted, the dye receiving layer transfer step and the image recording step can be separately controlled, respectively. Since a sufficient distance over which the cold-releasing is carried out in the dye receiving layer recording section can be ensured in particular and a size (a diameter in particular) of the larger diameter drum can be optimized, stability (driving stability) of the larger diameter drum is further improved and stability of thermal transfer recording the image is further improved.

The cleaning mechanism which contacts with the surface of the intermediate record support is provided which moves dependently on the intermediate record support moving at the same speed as that of the support or at a lower speed than that of the intermediate record support. For example, oil on the surface of the intermediate record support can be removed and stability of the thermal transfer recording can be further improved.

Consequently, a high quality image having glossiness and good image stability can be contained (for example, using the digital mode) instantly and more speedily on plain paper in comparison with the silver halide conventional photograph. Since the single dye transferer and plain paper can be used, a running cost (as to the thermal transfer recording or the thermal transfer printing) can be substantially the same as that of the silver halide conventional photograph. It is noted that the thermal transfer recording apparatus according to the present invention is particularly preferable for producing a photograph which is obtained by printing an image taken by a so-called digital camera.

EXAMPLES

The present invention is described further concretely and in detail with the following Examples and Comparative Examples. However, these Examples are merely examples of the present invention, and the present invention is not particularly limited by such examples in any way.

Example 1

An apparatus which was similar to the thermal transfer recording apparatus shown FIG. 1 was manufactured and used in Example 1.

(1) Construction of the Thermal Transfer Recording Apparatus

A larger diameter drum having a diameter of 200 mm, a width of 260 mm and a rubber member 602 of which hardness was 60 degrees on a surface layer thereof was used. A dye receiving layer transfer section 100, and image recording sections for Y, M and C 200, 300, and 400 were spaced at an interval of 110 mm outside an intermediate record support 610 on an outer periphery of the larger diameter drum.

Edge-face heads (A4 size, 300 dpi) were used as a dye receiving layer transfer head 130 and image recording heads for Y, M and C 230, 330 and 430. Cold-releasing mechanisms (for example, a means which presses a dye receiving layer transferer or a dye transferer to the intermediate record support such as a wedge-shaped member or a roller) 140, 240, 340 and 440 were provided with the dye receiving layer transfer section 100, the image recording sections for Y, M and C 200, 300, and 400, respectively, and further roll rewinding sections and roll winding sections 120, 150, 220, 250, 320, 350, 420 and 450 for the dye receiving layer transferer 110 and the dye transferers for Y, M and C 210, 310 and 410 were also provided with those sections. A drum having a diameter of 50 mm was used as a smaller diameter drum 560 in the image transfer section. A roller having a diameter of 20 mm was used as a smaller diameter drum 540 which also functioned as a cold-releasing mechanism. A corner head (for A4 size, 300 dpi) was used as an image transfer head 530.

Moreover, protruding portions 604 which engaged with sprocket holes 618 of the intermediate record support 610 were provided with both edge portions of an outer periphery of the larger diameter drum 600.

(2) Manufacture of the Recording Temporary Support

A polyimide belt-form film having a thickness of 25 μm and a width of 260 mm was used as a substrate 612 for the intermediate record support 610. After both edge portions of the belt each having a width of 10 mm were made 50 μm in thickness, the sprocket holes 618 which engaged with the protruding portions 604 of the larger diameter drum 600 were formed in the edge portions.

A following functional layer 614 was formed on an outside of a portion having a thickness of 25 μm of the intermediate record support except for both of the edge portions each having a thickness of 50 μm. It is noted that the functional layer 614 comprised two layers and the lower layer was formed to have a thickness of 5 μm and the upper was formed to have a thickness of 10 μm.

The lower layer of the functional layer 614 was porous. After preparing the following composition to be applied, the composition was applied on the outside of the substrate 612 for the intermediate record support 610 using a die coater. Drying the applied composition formed the lower layer so as to obtain the lower layer.

Fluororubber . . . 10 parts by weight (biton B (trade name) manufactured by Showa Denko-Du Pont Co. Ltd.)

Carbon . . . 5 parts by weight (MT carbon N-990 (trade name) manufactured by Cancarb Co. Ltd.)

Magnesium oxide . . . 5 parts by weight (Kyowamag 30 (trade name) manufactured by Kyowakagaku Co. Ltd.)

Polyamine curing agent . . . 0.4 parts by weight

Methyl iso-butyl ketone . . . 40 parts by weight

A composition to be applied for the upper layer was prepared using the same composition for the lower layer as described above except that 2 parts by weight of carbon were used and 1 part by weight of magnesium oxide was used. The upper layer was formed in the same manner as described above for forming of the lower layer, so intermediate record support 610 which is used in Example 1 was obtained.

Further, a heat-resistant sliding layer 616 having a thickness of 1 μm was provided on the inside of the substrate 612 for the intermediate record support 610, and the heat-resistant sliding layer 616 was substantially the same as heat-resistant sliding layers formed on back surfaces of the dye transferers 210, 310 and 410 which will be described later.

(3) Manufacture of the Dye Receiving Layer Transferee

A strong release PET film having a thickness of 12 μm having a release force (180 degrees release force: 30 g/inch) which is larger than that of a conventional release PET film was used as a substrate 112 for the dye receiving layer transferer 110.

A composition having the following components was prepared, and applied on the substrate 112 for the dye receiving layer transferer 110 as described above followed by drying, so that a dye receiving layer 114 having a thickness of 7–8 μm was formed.

Acrylic polyol resin . . . 12 parts by weight

Polyester resin having low molecular weight . . . 14 parts by weight

Vinyl chloride-vinyl acetate resin . . . 14 parts by weight

Silicone resin containing hydroxy group . . . 4 parts by weight

HALS . . . 2 parts by weight (It was a hindered amine based stabilizer.)

Benzophenone based UVA . . . 2 parts by weight

Solvent . . . 80 parts by weight (It was a mixture of toluene and MEK (methyl ethyl ketone).)

Further, a heat-resistant sliding layer having a thickness of 1 μm which was similar to the heat-resistant sliding layers formed on the back surfaces of the dye transfers as will be described later was provided on the back surface of the substrate for the dying receiving layer transferee.

(4) Manufacture of Dye Transferer

A commercially available PET film having a thickness of 6 μm was used as substrates for the dye transferers for Y, M and C 210, 310 and 410. A composition having the following component was prepared, and applied on the substrates for the dye receiving layer transferers described above and dried, so that heat-resistant sliding layers each having a thickness of 1 μm were formed.

Acrylic polyol resin . . . 100 parts by weight

Modified silicone oil . . . 10 parts by weight

Talc . . . 10 parts by weight

Isocyanate compound . . . 20 parts by weight

Solvent . . . 60 parts by weight (It was a mixture of toluene and MEK (methyl ethyl ketone).)

The following ink (dye) composition for Y was prepared in order to manufacture the dye transferer for Y 210. The dye transferer for Y 210 was obtained which had a dye layer for Y having a thickness of 0.8 μm on the front surface thereof.

Pyridone azo-based yellow dye . . . 2 parts by weight

Quinophtalone-based yellow dye . . . 1 parts by weight

AS resin . . . 4 parts by weight (Cebian N-080 (trade name) manufactured by DAICEL CHEMICAL INDUSTRIES, LTD.: It was prepared by polymerizing a mixture of monomers containing 30% acrylonitrile by weight.)

Solvent . . . 15 parts by weight (It was a mixture of toluene and MEK (methyl ethyl ketone).)

An ink (dye) composition for M and an ink (dye) composition for C were prepared in order to manufacture the dye transferer for M 310 and the dye transferer for C 410. The dye transferer for M 310 and the dye transferer for C 410 were manufactured in the same manner as described with regard to the manufacture of the dye transferer for Y 210.

(5) Thermal Transfer Recording

Thermal transfer recording was carried out with the above described thermal transfer recording apparatus. A dye transfer receiving layer having an A6 size (150 mm in width and 100 mm in length) was transversely cut off and transferred onto the intermediate record support 610 at a rate of 5 ms/line with a pitch of 110 mm using the dye receiving layer transfer head 130 in the dye receiving layer transfer section 100.

When a leading edge portion of the transferred dye receiving layer arrived just beneath the image recording head for Y 230 in the image recording section for Y 200, recording an image for Y was started. Subsequently, recording images for M and C were carried out stepwise using the image recording heads for M 330 and for C 430.

Finally, the receiving layer on which the image was recorded was re-transferred wholly onto plain paper (which was cast-coated paper: Espricoat C (trade name) manufactured by Nippon Paper Industries.) 510 with the image transfer head 530 in the image transfer section 500.

A glossy and high quality image was obtained by thermal transfer recording of Example 1. It took 35 seconds to obtain the first print. However, when thermal transfer recording was carried out continuously, it took 7 seconds per one print.

When thermal transfer recording was carried out continuously in the thermal transfer recording of Example 1, the above five heads were operated simultaneously.

Example 2

An apparatus which was similar to the thermal transfer recording apparatus shown in FIG. 5 was manufactured and used in Example 2.

(1) Construction of the Thermal Transfer Recording Apparatus

A smaller diameter drum 620 having a diameter of 50 mm and a width of 260 mm was used. The dye receiving layer transfer section 100 was arranged outside of the intermediate record support 610 on the outer periphery of the smaller diameter drum. The larger diameter drum 600 having a diameter of 200 mm and a width of 260 mm was used which had a rubber member of a hardness of 60 degrees around the surface thereof. The image recording sections for Y, M and C 200, 300 and 400 were spaced by a spacing of 110 mm outside of and around the intermediate record support 610 on the outer periphery of the larger diameter drum.

The thermal transfer recording apparatus was constructed in the same manner as described in Example 1 (1) except for the above construction.

(2) Manufacture of the Recording Temporary Support, (3) Manufacture of the Dye Receiving Layer Transferer and (4) Manufacture of the Dye Transferer The intermediate record support, the dye receiving layer transferer and the dye transferers were manufactured as in Example 1.

(5) Thermal Transfer Recording

Thermal transfer recording was carried out using a method similar to Example 1.

A glossy and high quality image was obtained by the thermal transfer recording of Example 2. It took 35 seconds to obtain the first print. However, when the thermal transfer recording was carried out continuously, it took 7 seconds per one print.

When the thermal transfer recording was carried out continuously in the thermal transfer recording of Example 2, the above five heads were operated simultaneously.

Example 3

An apparatus which was similar to the thermal transfer recording apparatus shown in FIG. 6 was manufactured and used in Example 3 except that the apparatus had neither the cleaning mechanism 700 nor the meandering preventive mechanism 800 for the intermediate record support. It is noted that the cleaning mechanism 700 and the meandering preventive mechanism 800 for the intermediate record support shown in FIG. 6 will be explained in Example 4.

(1) Construction of the Thermal Transfer Recording Apparatus

A larger diameter drum 600 having a diameter of 200 mm, and a width of 260 mm was used which had a rubber member having a hardness of 70 degrees around the surface of the larger diameter drum. The image recording sections for Y, M and C 200, 300 and 400 were spaced by a spacing of 110 mm outside of and around the intermediate record support 610 on the outer periphery of the larger diameter drum.

Edge-face heads (for A4 size, 300 dpi) were used as the dye receiving layer transfer head 130 and the image recording heads for Y, M and C 230, 330 and 430. Cold-releasing mechanisms 140, 240, 340 and 440 were provided with the dye receiving layer transfer section 100 and the image recording sections for Y, M and C 200, 300 and 400, respectively. Further, the roll rewinding sections and winding sections 120, 150, 220, 250, 320, 350, 420 and 450 for the dye receiving layer transferer 110 and the dye transferers for Y, M and C 210, 310 and 410 were provided. The drum having a diameter of 50 mm was adopted as the smaller diameter drum 560 in the image transfer section 500. A roller having a diameter of 10 mm was adopted as a smaller diameter drum 550 which also functioned as a nip roller. A roller having a diameter of 20 mm was adopted as the smaller diameter drum (which was a release roller and also an auxiliary drive roller) 540 which also functioned as the cold-releasing mechanism. A corner head (for A4 size, 300 dpi) was used as the image transfer head 530. A smaller diameter drum 640 which functioned as a tension adjusting roller was provided between the smaller diameter drum (auxiliary drive roller) 540 and the smaller diameter drum (which also functioned as a guide roller) 620.

Further, sprockets 604 which engaged with sprocket holes 618 of the intermediate record support 610 were provided with the edge portions of the outer periphery of the larger diameter drum 600.

(2) Manufacture of the Recording Temporary Support

An intermediate record support of Example 3 was manufactured as described in section (2) Manufacture of the recording temporary support in Example 1 except that a heat-resistant sliding layer was not formed.

(3) Manufacture of the Dye Receiving Layer Transferer and (4) Manufacture of the Dye Transferer A dye receiving layer transferer and dye transferers of Example 3 were manufactured as in section (3) Manufacture of the dye receiving layer transferer and section (4) Manufacture of the dye transferee described in Example 1. Manufacture (5) Thermal Transfer Recording Thermal transfer recording was carried out as in Example 1.

A glossy and high quality image was obtained by the thermal transfer recording of Example 3. It took 35 seconds to obtain the first print. However, when the thermal transfer recording was carried out continuously, it took 7 seconds per one print.

When the thermal transfer recording was carried out continuously in the thermal transfer recording of Example 3, the above five heads were operated simultaneously.

Example 4

An apparatus which was similar to the thermal transfer recording apparatus shown in FIG. 6 was manufactured and used in Example 4. Therefore, the thermal transfer recording apparatus in Example 4 comprised the cleaning mechanism 700 and the meandering preventive mechanism 800 for the intermediate record support in addition to the thermal transfer recording apparatus described in Example 3. However, it is noted that the sprocket manner driving mechanism was not used as the driving method for the intermediate record support in the thermal transfer recording apparatus described in Example 4.

(1) Construction of the Thermal Transfer Recording Apparatus

The thermal transfer recording apparatus in Example 4 was constructed in a similar manner as in the thermal transfer recording apparatus in Example 3, section (1) except for the following:

The cleaning mechanism 700 for the intermediate record support was arranged outside the intermediate record support 611 on the outer periphery of the smaller diameter drum 620. The cleaning sheet 720 had a width which was the same as that of the intermediate record support 610. The rewinding roller 730 and the winding roller 740 for the cleaning sheet 720 were so controlled that the cleaning sheet ran at a speed of 1/10 of a speed at which the intermediate record support 610 ran.

The meandering preventive mechanism 800 comprising slope forming guides along both edge portions of the intermediate record support 610 was provided between the smaller diameter drum (the auxiliary drive roller) 540 and the smaller diameter drum (the guide roller) 620.

It is noted that no protruding portion which engaged with sprocket holes of the intermediate record support 610 was provided with the end portions of the larger diameter drum 600 round its outer periphery.

(2) Manufacture of the Recording Temporary Support

A polyimide film (Captone 100EN (trade name)) having a thickness of 25 μm and a width of 260 mm was used as the substrate for the intermediate record support 610. The ployimide film was subjected to a high adhesion treatment using plasma and to a thermal treatment a temperature of 250° C. The film had a length of 1160 mm. Both the end portions of the film were abutted to each other, and joined together with a polyimide adhensive tape (No.360PC (trade name) manufactured by Nitto Denko Corporation), so that the intermediate record support 610 in Example 4 was obtained as a belt-form intermediate record support 610.

(3) Manufacture of the Dye Receiving Layer Transferer

A commercially available strong release PET film (180 degrees release force of 30 g/inch) having a thickness of 12 μm was used as the substrate for the dye receiving layer transferer 110. A composition having the following components was prepared, applied on the substrate for the dye receiving layer transferer 110 described above and dried, so that a dye receiving layer having a thickness of 6–8 μm was formed.

Acrylic polyol resin . . . 12 parts by weight

Polyester resin having low molecular weight . . . 14 parts by weight

Vinyl chloride-vinyl acetate resin . . . 14 parts by weight

Alkyd-modified silicone resin . . . 4 parts by weight

Higher fatty acid ester . . . 1 parts by weight

Benzophenone based UVA . . . 2 parts by weight

Solvent . . . 80 parts by weight (It was a mixture of toluene and MEK (methyl ethyl ketone).)

Further, a heat-resistant sliding layer having a thickness of 1 μm which was substantially the same as the heat-resistant sliding layers formed on the back surfaces of the dye transferers as described later was provided with the back surface of the substrate for the dye receiving layer transferer 110.

(4) Manufacture of the Dye Transferer

The dye transferers for Y, M and C 210, 310 and 410 were prepared using a method similar to the method described in Example 1 except that the composition for the heat-resistant sliding layers was replaced with the following composition.

Acrylic polyol resin . . . 8 parts by weight

AS resin . . . 2 parts by weight (It was the same as that in Example 1)

Modified silicone oil . . . 0.8 parts by weight

Talc . . . 1 parts by weight

Solvent . . . 60 parts by weight (It was a mixture of toluene and MEK (methyl ethyl ketone).)

(5) Thermal Transfer Recording

Thermal transfer recording was carried out as in Example 1.

A glossy and high quality image was obtained by the thermal transfer recording of Example 4. It took 35 seconds to obtain the first print. However, when the thermal recording was carried out continuously, it took 7 seconds per one print.

When the thermal transfer recording was carried out continuously in the thermal transfer recording of Example 4, the above five heads were operated simultaneously.

Example 5

An apparatus which was similar to the thermal transfer recording apparatus shown in FIG. 8 except that the apparatus had neither the cleaning mechanism 700 nor the meandering preventive mechanism 800 for the intermediate record support was manufactured and used in Example 5. The cleaning mechanism 700 and the meandering preventive mechanism 800 for the intermediate record support shown in FIG. 8 will be explained in Example 6.

(1) Construction of the Thermal Transfer Recording Apparatus

A larger diameter drum 600 having a diameter of 150 mm and a width of 260 mm was used which had a rubber member having a hardness of 70 degrees on a surface thereof. The image recording sections for Y, M and C 200, 300 and 400 were spaced by a spacing of 110 mm outside of and around the intermediate record support 610 on the outer periphery of the larger diameter drum. The smaller diameter drum 620 having a diameter of 50 mm was used, on which the dye receiving layer transfer section 100 was arranged outside of the intermediate record support 610 on the outer periphery of the smaller diameter drum.

The edge-face heads (for A4 size, 300 dpi) were used as the dye receiving layer transfer head 130 and the image recording heads for Y, M and C 230, 330 and 430. The cold-releasing mechanisms 140, 240, 340 and 440 were provided with the dye receiving layer transfer section 100 and the image recording sections for Y, M and C 200, 300 and 400. Further, the roll rewinding sections and winding sections 120, 150, 220, 250, 320, 350, 420 and 450 for the dye receiving layer transferer 110 and the dye transferees for Y, M and C 210, 310 and 410 were provided. A drum having a diameter of 50 mm was adopted as the smaller diameter drum 560 in the image transfer section 500. A roller having a diameter of 10 mm was adopted as the smaller diameter drum 550 which functioned as the nip roller. A roller having a diameter of 20 mm was adopted as the smaller diameter drum (which was a release roller or an auxiliary drive roller) 540 which also functioned as the cold-releasing mechanism. A corner head (for A4, 300 dpi) was used as the image transfer head 530. A smaller diameter drum 640 which functioned as the tension adjusting roller was provided between the smaller diameter drum (the auxiliary drive roller) 540 and the smaller diameter drum (which also functioned as a guide roller) 620.

It is noted that no protruding portions which engaged with sprocket holes of the intermediate record support 610 were provided with the end portions of the larger diameter drum 600 around its outer periphery.

(2) Manufacture of the Recording Temporary Support

A polyimide film (Captone 100EN (trade name)) having a thickness of 25 μm and a width of 260 mm was used as the substrate for the intermediate record support 610. The following functional layer was formed on the outside of the substrate for the intermediate record support. It is noted that the functional layer was composed of two layers, and the lower layer was formed to have a thickness of 5 μm and the upper layer was formed thickness of 10 μm.

The lower layer of the functional layer was porous. After preparing the following composition to be applied, the composition was applied on the outside of the substrate for the intermediate record support using a die coater. Drying the applied composition formed the lower layer.

Fluororubber . . . 10 parts by weight (biton B (trade name) manufactured by Showa Denko-Du Pont Co. Ltd.)

Carbon . . . 5 parts by weight (MT carbon N-990 (trade name) manufactured by Cancarb Co. Ltd.)

Magnesium oxide . . . 5 parts by weight (Kyowamag 30 (trade name) manufactured by Kyowakagaku Co. Ltd.)

Polyamine curing agent . . . 0.4 parts by weight

Methyl iso-butyl ketone . . . 40 parts by weight

A composition to be applied for the upper layer was prepared in the same as described in the preparation of the composition to be applied for the lower layer except that 2 parts by weight of carbon was used and 1 parts by weight of magnesium oxide was used. The upper layer was formed in the same manner as described in the forming of the lower layer, so that the intermediate record support 610 which was used in Example 5 was obtained.

No sprocket holes were provided in the edge portions of the intermediate record support 610.

(3) Manufacture of the Dye Receiving Layer Transferer and (4) Manufacture of the Dye Transferer The dye receiving layer transferer and the dye transferers of Example 5 were manufactured using a method similar to the method described in section (3) manufacture of the dye receiving layer transferer and section (4) Manufacture of the dye transferer in Example 1.

(5) Thermal Transfer Recording

Thermal transfer recording was carried out as in Example 1.

A glossy and high quality image was obtained by the thermal transfer recording of Example 5. It took 35 seconds to obtain the first print. However, when the thermal transfer recording was carried out continuously, it took 7 seconds per one print.

When the thermal transfer recording was carried out continuously in the thermal transfer recording of Example 5, the above five heads were operated simultaneously.

Example 6

An apparatus which was similar to the thermal transfer recording apparatus shown in FIG. 8 was manufactured and used in Example 6. Therefore, the thermal transfer recording apparatus of Example 6 was the apparatus of Example 5 in which the cleaning mechanism 700 and the meandering preventive mechanism 800 for the intermediate record support were added.

(1) Construction of the Thermal Transfer Recording Apparatus

The thermal transfer recording apparatus of Example 6 was constructed in the same manner as that described in section (1) Construction of the thermal transfer recording apparatus in Example 5 except for the following constructions:

The cleaning mechanism 700 for the intermediate record support was arranged outside of the intermediate record support 610 on the outer periphery of the smaller diameter drum 620. The cleaning sheet 720 had a width which was the same as that of the intermediate record support 610. The rewinding roller 730 and the winding roller 740 for the cleaning sheet 720 were so controlled that the cleaning sheet ran at a speed of 1/10 of a speed at which the intermediate record support 610 ran. An aramid/polyester blend textile was used as the cleaning sheet 720.

The meandering preventive mechanism 800 having slope forming guides was provided on the edge portions of the intermediate record support between the smaller diameter drum 620 and the smaller diameter drum 630.

(2) Manufacture of the Recording Temporary Support, (3) Manufacture of the Dye Receiving Layer Transferer and (4) Manufacture of the Dye Transferer The intermediate record support, the dye receiving layer transferer and the dye transferers of Example 6 were manufactured using methods similar to the methods in section (2) Manufacture of the recording temporary support, section (3) Manufacture of the dye receiving layer and section (4) Manufacture of the dye transferer described in Example 4.

(5) Thermal Transfer Recording

Thermal transfer recording was carried out as in Example 1.

A glossy and high quality image was obtained by the thermal transfer recording of Example 6. It took 35 seconds to obtain the first print. However, when the thermal transfer recording was carried out continuously, it took 7 seconds per one print.

When the thermal transfer recording was carried out continuously in the thermal transfer recording of Example 6, the above five heads were operated simultaneously.

It is noted that the present invention was based on the Japanese Patent Application Nos. 11-169252 (which was filed on Jun. 16, 1999), 11-169254 (which was Jun. 16, 1999), 2000-45485 (which was filed on Feb. 23, 2000) and 2000-45486 (which was filed on Feb. 23, 2000), contents of which are incorporated herein with reference to them.

What is claimed is:

1. A thermal transfer recording apparatus comprising:

a plurality of drums;

an intermediate record support forming a closed loop and extending over said plurality of drums;

a dye receiving layer transfer section having a dye receiving layer transfer head facing a part of said intermediate record support on an outer periphery of one drum of said plurality of the drums;

an image recording section having at least one image recording head facing a part of said intermediate record support on the outer periphery of said one drum, said image recording section being located outside of said intermediate record support;

an image transfer section having an image transfer head facing said intermediate record support inside the closed loop;

a main drive section being operable to drive said one drum so as to run said intermediate record support;

an auxiliary drive section being operable to transmit a force to another drum of said plurality of drums which is different from said one drum, an outer periphery of said another drum contacting a part of the closed loop of said intermediate record support, wherein a peripheral speed of said auxiliary drive section is faster than that of said main drive section.

2. The thermal transfer recording apparatus according to claim 1, wherein said one drum is a larger diameter drum, and said image recording section comprises a cold-releasing mechanism arranged around said larger diameter drum.

3. The thermal transfer recording apparatus according to claim 1, further comprising at least two additional image recording sections, said image recording section and said at least two additional recording sections forming at least three image recording sections located in tandem, wherein a first of said at least three image recording sections is for yellow, a second of said at least three image recording sections is for magenta and a third of said at least three image recording sections is for cyan.

4. The thermal transfer recording apparatus according to claim 1, wherein said intermediate record support comprises a substrate made of a polyimide film.

5. The thermal transfer recording apparatus according to claim 1, wherein said polyimide film has a heat shrinkage ratio of not more than 0.1%.

6. The thermal transfer recording apparatus according to claim 4, wherein said polyimide film has an elongation of not more than 60%.

7. The thermal transfer recording apparatus according to claim 4, wherein said polyimide film has a contact angle of not more than 55 degrees.

8. The thermal transfer recording apparatus according to claim 4, wherein said polyimide film has a thickness of not more than 40 $\mu$m.

9. The thermal transfer recording apparatus according to claim 4, wherein an outer surface of said polyimide film is roughened by a shape effect.

10. The thermal transfer recording apparatus according to claim 1, wherein said intermediate record support comprises a substrate made of a polyimide strip-like film, both end portions of said polyimide strip-like film being connected with a polyimide based adhesive tape.

11. The thermal transfer recording apparatus according to claim 1, wherein said intermediate record support comprises a substrate and a functional layer outside of said substrate.

12. The thermal transfer recording apparatus according to claim 11, wherein said functional layer of said intermediate record support has a heat insulating property.

13. The thermal transfer recording apparatus according to claim 11, wherein said functional layer of said intermediate record support comprises a fluororubber and a porous section having a heat insulating property.

14. The thermal transfer recording apparatus according to claim 11, wherein said functional layer comprises a porous layer on a surface thereof through which said functional layer and said substrate of the closed loop of said intermediate record support contact.

15. The thermal transfer recording apparatus according to claim 1, wherein said intermediate record support comprises a substrate and a heat-resistant sliding layer inside said substrate of the closed loop.

16. The thermal transfer recording apparatus according to claim 1, wherein a circumferential surface of said one drum comprises an elastic member having a rubber hardness of 60–70 degrees surface.

17. The thermal transfer recording apparatus according to claim 16, wherein edge portions of said intermediate record support comprise sprocket holes thereon, and edges of said one drum comprise protruding portions thereon which engage with said sprocket holes.

18. The thermal transfer recording apparatus according to claim 1, wherein each of said dye receiving layer transfer section, said image recording section and said image transfer section comprises a cold-releasing mechanism, said image transfer section has a cold-releasing, angle of not less than 45 degrees, and said intermediate record support, a dye receiving layer and an image receiver are cooled together while being maintained integrally from said image transfer head to said cold-releasing mechanism in said image transfer section.

19. The thermal transfer recording apparatus according to claim 1, wherein said dye receiving layer transfer section has a dye receiving layer transferer comprising a dye receiving layer on a substrate, said dye receiving layer being adapted to be cut off in a given shape and transferred by being heated with said dye receiving layer transfer head from a back surface of said dye receiving layer transferee.

20. The thermal transfer recording apparatus according to claim 1, wherein said dye receiving layer transfer section has a dye receiving layer transferer comprising a dye receiving layer comprising a polyol resin having a hydroxyl value of not less than 30, a polyester resin having a bisphenol skeleton, a vinyl chloride-vinyl acetate copolymer resin, and a silicone resin.

21. The thermal transfer recording apparatus according to claim 20, wherein said dye receiving layer further comprises a crosslinking agent.

22. The thermal transfer recording apparatus according to claim 20, wherein said dye receiving layer further comprises at least one of a higher fatty acid ester, a derivative of said higher fatty acid ester, and a higher fatty acid-modified silicone oil.

23. The thermal transfer recording apparatus according to claim 1, wherein said dye receiving layer transfer section has a dye receiving layer transferer comprising a substrate and a heat-resistant sliding layer on a back surface of said substrate of said dye receiving layer transferee.

24. The thermal transfer recording apparatus according to claim 1, wherein said dye receiving layer transfer head and said at least one image recording head are located such that a spacing between them is equivalent to or larger than a pitch of an image size to be recorded.

25. The thermal transfer recording apparatus according to claim 1, wherein said image transfer section comprises a drum which functions as a nip roller at a position at which said intermediate record support is released from an image receiver.

26. The thermal transfer recording apparatus according to claim 1, further comprising a cleaning mechanism operable to remove stains while running dependently on a running of said intermediate record support at a same speed as that of said intermediate record support or while running at a lower speed than that of said intermediate record support.

27. The thermal transfer recording apparatus according to claim 26, wherein said cleaning mechanism is of roll-using.

28. The thermal transfer recording apparatus according to claim 27, wherein said roll-using cleaning mechanism comprises a silicone rubber having a porosity of not less than 10% and a hardness of not more than 20 degrees.

29. The thermal transfer recording apparatus according to claim 26, wherein said cleaning mechanism is of sheet-using and comprises a rewinding section and a winding section.

30. The thermal transfer recording apparatus according to claim 26, wherein said cleaning mechanism is one of sheet-using or roll-using and comprises a nonwoven fabric made of a pulp or plastic material.

31. The thermal transfer recording apparatus according to claim 1, further comprising a meandering preventive mechanism having L-shaped guides or slopes forming guides to edge portions of said intermediate record support.

32. The thermal transfer recording apparatus according to claim 1, further comprising a tension adjusting roller in a region downstream of said image transfer section and upstream of said dye receiving layer transfer section, said tension adjusting roller providing a tension with said intermediate record support from outside of said intermediate record support.

33. The thermal transfer recording apparatus according to claim 1, wherein said at least one image recording head of said image recording section is a single image recording head and said image recording section comprises a dye transfer section comprising a dye transferer in which dye layers for yellow, magenta and cyan are formed in series.

34. A thermal transfer recording apparatus comprising:

a plurality of drums:

an intermediate record support forming a closed loop and extending over said plurality of drums;

a dye receiving layer transfer section having a dye receiving layer transfer head facing a part of said intermediate record support on an outer periphery of one drum of said plurality of drums;

an image recording section having at least one image recording head facing a part of said intermediate record support on an outer periphery of a different drum which is different from said one drum, said image recording section being located outside of said intermediate record support;

an image transfer section having an image transfer head facing said intermediate record support inside the closed loop;

a main drive section being operable to drive said different drum so as to run said intermediate record support; and an auxiliary drive section being operable to transmit a force to another drum which is different from said different drum, an outer periphery of said another drum contacting a part of the closed loop of said intermediate record support, wherein a peripheral speed of said auxiliary drive section is faster than that of said main drive section.

* * * * *